US005210065A

United States Patent [19]

Tanaka et al.

[11] Patent Number: 5,210,065

[45] Date of Patent: May 11, 1993

[54] COLOR-FORMING RECORDING MATERIAL

[75] Inventors: Michio Tanaka, Hatsukaichi; Koji Kawai, Ohtake; Hiroyoshi Tarumoto, Iwakuni; Hisaya Miki, Hiroshima; Keiki Kishikawa, Yamaguchi; Masato Kawamura, Iwakuni; Masatoshi Nitabaru, Yamaguchi; Terunori Fujita, Ohtake, all of Japan

[73] Assignee: Mitsui Petrochemical Industries, Ltd., Tokyo, Japan

[21] Appl. No.: 769,737

[22] Filed: Oct. 2, 1991

[30] Foreign Application Priority Data

| | | | |
|---|---|---|---|
| Oct. 4, 1990 | [JP] | Japan | 2-268184 |
| Oct. 4, 1990 | [JP] | Japan | 2-268186 |
| Apr. 22, 1991 | [JP] | Japan | 3-116679 |
| Jun. 26, 1991 | [JP] | Japan | 3-154271 |

[51] Int. Cl.[5] ..... B41M 5/30

[52] U.S. Cl. ..... 503/202; 503/209; 503/217; 503/225

[58] Field of Search ..... 427/150–152; 503/202, 208, 209, 212, 216–218, 225

[56] References Cited

U.S. PATENT DOCUMENTS 4,398,753 8/1983 Asano et al. ..... 503/209

FOREIGN PATENT DOCUMENTS 62-142681 6/1987 Japan .
62-181361 8/1987 Japan .
62-27168 10/1987 Japan .
63-94880 4/1988 Japan .
63-173687 7/1988 Japan .
63-256486 10/1988 Japan .
64-49679 2/1989 Japan .
2196137 4/1988 United Kingdom .

*Primary Examiner*—Pamela R. Schwartz
*Attorney, Agent, or Firm*—Birch, Stewart, Kolasch & Birch

[57] ABSTRACT

A color-forming recording material containing:
(a) an aromatic diamine,
(b) an oxidizing agent such as a quinoid type electron-accepting compound, and
(c) an acidic substance such as an aromatic carboxylic acid.

13 Claims, 24 Drawing Sheets

COLOR-FORMING RECORDING MATERIAL

DETAILED DESCRIPTION OF THE INVENTION

The present invention relates to a color-forming recording material. More specifically, it relates to a color-forming recording material useful for use with a data reading apparatus using visible light and/or near infrared light.

A color-forming recording material comprising a dye which is colorless itself and an acidic substance is conventionally and widely put to practical use as a thermosensitive recording material.

With an advance in electronic technologies and information processing systems in recent years, there is seen the practical use of data reading apparatus which respond to electromagnetic waves in a long wave region from visible light to near infrared light. However, conventional color-forming recording materials containing phthalide-based compounds as a color-forming dye have no practical absorption in such a long wave region.

For this reason, there have been conventional methods for shifting absorption wavelength of known phthalide-based compounds up to a long wavelength region of near infrared light. In one method, a substituent is introduced onto the compound to produce a substituent effect, or in another method, the o-electron conjugation is extended. In these cases, however, the compounds have an increased molecular weight, and it is difficult to produce such compounds. Moreover, the absorption of these compounds in a near infrared region is still not satisfactory, and formed images are unstable, liable to discolor and poor in light resistance.

In recently years, therefore, a variety of color-forming dyes have been proposed which form dyes to absorb electromagnetic waves in a long wave region.

Japanese Laid-Open Patent Publication No. 181361/1987 proposes a color-forming recording material containing either a phenylenediamine derivative or a naphthylenediamine derivative and an acidic substance. This color-forming recording material has a defect in an extraordinary change of a color with time after the color has been formed.

Japanese Laid-Open Patent Publication No. 256486/1988 proposes a color-forming recording material containing either phenylenediamine derivative or a naphthylenediamine derivative and a quinoid type electron-accepting compound. The present inventor has studied this proposed color-forming recording material, and found that it is difficult to form a substantial color with the same. It is considered difficult to put it to practical use.

Japanese Laid-Open Patent Publication No. 94880/1988 discloses a color-forming recording material containing either a phenylenediamine derivative or a naphthylenediamine derivative and an organohalogen compound which generates a halogen radical under heat and/or light. The generated organohalogen radical, e.g. chlorine radical, draws out a hydrogen radical from a neighboring compound to form a strong acid such as hydrohalogenic acid, e.g. hydrochloric acid. Therefore, when this recording paper is used for copying a book, documents, etc., the durability of the copied paper is impaired in a long period of time.

It is an object of the present invention to provide a novel color-forming recording material.

It is another object of the present invention to provide a color-forming recording material which forms a color having a practically sufficient intensity immediately after subjected to a color-forming operation, and in which the color-forming portion has high absorption in a wide region from visible light to near infrared light.

It is further another object of the present invention to provide a novel color-forming recording material which can overcome the problems of the above-described conventional color-forming recording materials.

The other objects and advantages of the present invention will be apparent from the following description.

According to the present invention, the above objects and advantages of the present invention are achieved, first of all, by a color-forming recording material containing:

(a) an aromatic diamine (b) an oxidizing agent, and (c) an acidic substance.

The color-forming recording material of the present invention contains the above components (a), (b) and (c), and it can give a dye having very high absorption intensity in a region from visible light to near infrared light and fastness only when the above components are brought into contact. According to the present invention, therefore, there is advantageously provided a practical color-forming recording material which gives a color readable with a semiconductor laser.

Figure 1:
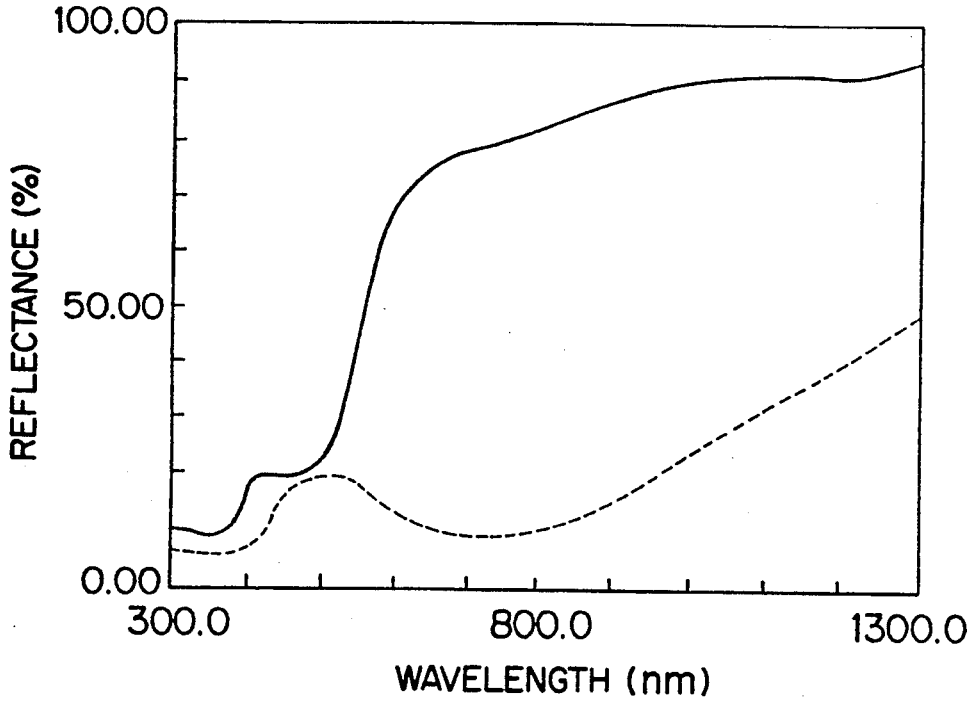
FIG. 1 is a reflection spectrum chart of a color-forming recording material obtained in Example 1 before and after color formation.

The aromatic diamine used as a component (a) in the present invention refers to aromatic diamines.

Examples of the aromatic diamines as a component (a) include:

compounds of the formula (1), $$R^1-\overset{\overset{R^2}{|}}{N}-X-\overset{\overset{R^3}{|}}{N}-R^4 \qquad (1)$$

wherein each of $R^1$ and $R^4$ is, independently of the other, a substituted or unsubstituted aryl group, each of $R^2$ and $R^3$ is, independently of the other, a hydrogen atom, a lower alkyl group, a substituted or unsubstituted aryl group or a substituted or unsubstituted aralkyl group, and X is a substituted or unsubstituted arylene group, and compounds of the formula (2), $$R^1-\overset{\overset{R^2}{|}}{N}-X-\overset{\overset{R^3}{|}}{N}-CO-R \qquad (2)$$

wherein $R^1$, $R^2$, $R^3$ and X are as defined in the above formula (1), and R is an alkyl group, an aryl group or an aralkyl group.

In the above formula (1), each of $R^1$ and $R^4$ is, independently of the other, a substituted or unsubstituted aryl group. The aryl group preferably includes phenyl and naphthyl.

Each of $R^2$ and $R^3$ is, independently of the other, a hydrogen atom, a lower alkyl group, a substituted or unsubstituted aryl group or a substituted or unsubstituted aralkyl group. The lower alkyl group is preferably a linear or branched alkyl group having 1 to 4 carbon atoms, such as methyl, ethyl, n-propyl, iso-propyl, n-butyl, isobutyl, sec-butyl or tert-butyl.

The aryl group preferably includes phenyl and naphthyl, and the aralkyl group preferably includes benzyl and phenetyl.

X is a substituted or unsubstituted arylene group. The arylene group preferably includes 1,3-phenylene, 1,4-phenylene, 2,6-naphthylene, 1,4-naphthylene and 1,5-naphthylene.

In the definition of the above formula (1), examples of substituents on the substituted aryl group as $R^1$, the substituted aryl group and the substituted aralkyl group as $R^2$ or $R^3$, and the substituted arylene group as X are a halogen atom, a cyano group, a nitro group, an alkyl group, an aryl group, an aralkyl group, a hydroxyl group, an alkoxy group, an aryloxy group, an aralkyloxy group, an acyl group, a carboxyl group, an alkoxycarbonyl group, an aryloxycarbonyl group, an alkyl-substituted carbamoyl group, an aryl-substituted carbamoyl group, a sulfonic acid group, an alkylsulfonyl group, an arylsulfonyl group, an amino group, an alkyl-substituted amino group, an aryl-substituted amino group, pyrrolidino group, and a piperidino group.

The halogen atom preferably includes fluorine, chlorine and bromine.

The alkyl group is selected from those lower alkyl groups specified with regard to $R^2$ and $R^3$.

The aryl group preferably includes phenyl and tolyl.

The aralkyl group preferably includes benzyl and phenetyl.

The alkoxy group is preferably a linear or branched alkoxy group having 1 to 4 carbon atoms, such as methoxy, ethoxy, n-propoxy, iso-propoxy, n-butoxy, isobutoxy, sec-butoxy, or tert-butoxy.

The aryloxy group preferably includes phenoxy, methylphenoxy, and naphthoxy.

The aralkyloxy group preferably includes benzyloxy and phenetyloxy.

The acyl group preferably includes formyl acetyl, propionyl, butyryl, benzoyl, toluoyl and naphthoyl.

The alkoxycarbonyl group is preferably selected from those of which the alkoxy moiety is the same as the above linear or branched alkoxy group having 1 to 4 carbon atoms.

The aryloxycarbonyl group is preferably selected from those of which the aryl moieties are phenyl, tolyl and naphthyl.

The alkyl-substituted carbamoyl group is a carbamoyl group substituted with a linear or branched alkyl group having 1 to 4 carbon atoms, such as methylcarbamoyl, ethylcarbamoyl, dimethylcarbamoyl, methylethylcarbamoyl and diethylcarbamoyl.

The aryl-substituted carbamoyl group preferably includes phenylcarbamoyl, tolylcarbamoyl, naphthylcarbamoyl, diphenylcarbamoyl and phenylmethylcarbamoyl.

The alkylsulfonyl group is preferably selected from those of which the alkyl moiety is a linear or branched alkyl group having 1 to 4 carbon atoms.

The arylsulfonyl group is preferably selected from those of which the aryl moieties are phenyl, tolyl and naphthyl.

The alkyl-substituted amino group is preferably a mono- or di-substituted amino group selected from liner or branched alkyl group members having 1 to 4 carbon atoms, such as methylamino, dimethylamino, ethylamino, diethylamino, n-propylamino, di(n-propyl)amino, n-butylamino, di(n-butyl)amino, iso-propylamino, iso-butylamino, sec-butylamino, and tert-butylamino.

The aryl-substituted amino group is preferably a mono- or di-substituted amino group selected from aryl group members such as phenyl, tolyl and naphthyl, and it preferably includes phenylamino, diphenylamino, tolylamino and naphthylamino.

Further, in the definition of the formula (1), examples of substituents on the substituted aryl group as $R^4$ are preferably the following groups in addition to the substituents specified with regard to $R^1$, $R^2$ and $R^3$.

a group of the formula (1)-a

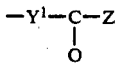

(1)-a wherein $Y^1$ is —O—, —NH—, —N(lower alkyl)—, —N(aryl)— or —N(aralkyl)—, and Z is a hydrogen atom, an alkyl group, an aryl group, an aralkyl group, an alkoxy group, an aryloxy group, an aralkyloxy group, an alkyl-substituted amino group or an aryl-substituted amino group, a group of the formula (1)-b

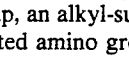

(1)-b wherein $Y^2$ is —O—, —NH—, —N(lower alkyl)—, —N(aryl)— or —N(aralkyl)— and $R^5$ is an alkyl group, an aryl group or an aralkyl group, and a group of the formula (1)-c,

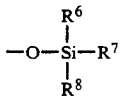

(1)-c wherein $R^6$, $R^7$ and $R^8$ are each independently an alkyl group, an aryl group or an aralkyl group.

Specific examples of the groups and moieties in the definitions of the formulae (1)-a, (1)-b and (1)-c are same as described hereinabove.

According to the definition of $R^4$, the compounds of the formula (1) can be classified as follows for convenience's sake.

Case (1): Compounds of the formula (1) wherein $R^4$ is an unsubstituted aryl group.

Case (2): Compounds of the formula (1) wherein $R^4$ is a substituted aryl group in which the substituent is other than those substituents of the formulae (1)-a, (1)-b and (1)-c.

Case (3): Compounds of the formula (1) wherein $R^4$ is a substituted aryl group in which the substituent is a group of the formula (1)-a.

The compounds in this case have the following formula (1)-1.

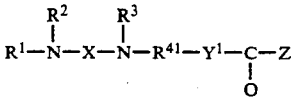

(1)-1 wherein $R^1$, $R^2$, $R^3$, X, $Y^1$ and Z are as defined above, and $R^{41}$ is an arylene group.

Case (4): Compounds of the formula (1) wherein $R^4$ is a substituted aryl group in which the substituent is a group of the formula (1)-b.

The compounds in this case have the following formula (1)-2.

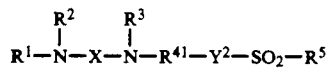

(1)-2 wherein $R^1$, $R^2$, $R^3$, $R^5$, X and $Y^2$ are as defined above, and $R^{41}$ is an arylene group.

Case (5): Compounds of the formula (1) wherein $R^4$ is a substituted aryl group in which the substituent is a group of the formula (1)-c.

The compounds in this case have the following formula (1)-3.

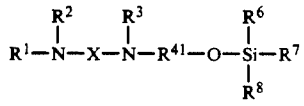

(1)-3 wherein $R^1$, $R^2$, $R^3$, $R^6$, $R^7$, $R^8$ are as defined above, and $R^{41}$ is an arylene group.

Further, in the formula (2), $R^1$, $R^2$, $R^3$ and X are same as defined in the formula (1), and specific examples thereof are clearly understood from the foregoing description.

In the formula (2), R is an alkyl group, an aryl group or an aralkyl group. Specific examples of these groups are same as specified with regard to the definition of the formula (1).

Specific examples of the aromatic diamine (a) of the formula (1) are preferably as follows.

Examples in the above cases (1) and (2): N,N-diphenyl-o-phenylenediamine, N,N'-diphenyl-m-phenylenediamine, N,N'-diphenyl-p-phenylenediamine, N,N'-tetraphenyl-p-phenylenediamine, N-phenyl-N-methyl-N'-phenyl-N'-methyl-p-phenylenediamine, N-phenyl-N-benzyl-N'-phenyl-N'-benzyl-p-phenylenediamine, N-(4-hydroxyphenyl)-N'-phenyl-p-phenylenediamine, N-(3-methoxyphenyl)-N'-phenyl-p-phenylenediamine, N-(4-methoxyphenyl)-N'-phenyl-p-phenylenediamine, N-(4-ethoxyphenyl)-N'-phenyl-p-phenylenediamine, N-(4-octadecyloxyphenyl)-N'-phenyl-p-phenylenediamine, N-(4-cyanophenyl)-N'-phenyl-p-phenylenediamine, N-(4-nitrophenyl)-N'-phenyl-p-phenylenediamine, N-(4-chlorophenyl)-N'-phenyl-p-phenylenediamine, N-p-tolyl-N'-phenyl-p-phenylenediamine, N-(3-chlorophenyl)-N'-phenyl-p-tolyl-p-phenylenediamine, 4'-(4''-anilinophenyl-)aminoacetophenone, 4'-(4''-anilinophenyl)aminobenzenesulfonic acid, 4'-(4''-anilinophenyl)aminobenzoic acid, N-(4-dimethylcarbamoylphenyl)-N'-phenyl-p-phenylenediamine, N-(4-aminophenyl)-N'-phenyl-p-phenylenediamine, N-(4-dimethylaminophenyl)-N'-phenyl-p-phenylenediamine, N,N'-bis(4-dimethylaminophenyl)-p-phenylenediamine, N-(4-aminophenyl)-N-phenyl-N'-(4-aminophenyl)-p-phenylenediamine, N-(4-anilinophenyl)-N'-phenyl-p-phenylenediamine, N,N'-bis(4-anilinophenyl)-p-phenylenediamine, N-(4-(3-methoxyphenylamino)phenyl)-N'-phenyl-p-phenylenediamine, N-(2-methyl-4-methoxyphenyl)-N'-phenyl-p-phenylenediamine, N-(1-methyl-4-hydroxyphenyl)-N'-phenyl-p-phenylenediamine, N-(2,3-dimethyl-4-hydroxyphenyl)-N'-phenyl-p-phenylenediamine, N-(4-methoxyphenyl)-N-methyl-N'-phenyl-p-phenylenediamine, N-(4-methoxyphenyl)-N'-methyl-N'-phenyl-p-phenylenediamine, N-(3-methoxyphenyl)-N-methyl-N'-phenyl-p-phenylenediamine, N-(3-methoxyphenyl)-N'-methyl-N'-phenyl-p-phenylenediamine, N-(4-tert-butylcarboxylphenyl)-N-ethyl-N'-phenyl-p-phenylenediamine, N-(4-tert-butylcarboxylphenyl)-N'-ethyl-N'-phenyl-p-phenylenediamine, N-(3-oxyphenyl)-N,N'-dimethylphenyl-p-phenylenediamine, and N-(3-oxyphenyl)-N-benzyl-N'-benzyl-N'-phenyl-p-phenylenediamine.

Examples in the above case (3), i.e. compounds of the formula (1)-1: N-(4-acetylaminophenyl)-N'-phenyl-p-phenylenediamine, N-(4-acetylaminophenyl)-N'-phenyl-m-phenylenediamine, N-(4-acetylaminophenyl)-N'-phenyl-N,N',N''-trimethyl-p-phenylenediamine, N-(4-acetylaminophenyl)-N'-phenyl-N,N'-diphenyl-p-phenylenediamine, N-(3-acetylaminophenyl)-N'-phenyl-p-phenylenediamine, N-(3-acetylaminophenyl)-N'-phenyl-N,N',N''-trimethyl-p-phenylenediamine, N-(3-acetylaminophenyl)-N'-phenyl-N,N'-diphenyl-p-phenylenediamine, N-(4-propionylaminophenyl)-N'-phenyl-p-phenylenediamine, N-(4-benzoylaminophenyl)-N'-phenyl-p-phenylenediamine, N-(3-benzoylaminophenyl)-N'-phenyl-p-phenylenediamine, N-(3-β-naphtoylaminophenyl)-N'-phenyl-p-phenylenediamine, N-(4-acetoxyphenyl)-N'-phenyl-p-phenylenediamine, N-(4-acetoxyphenyl)-N'-phenyl-N,N'-dimethyl-p-phenylenediamine, N-(4-acetoxyphenyl)-N'-phenyl-N,N'-diphenyl-p-phenylenediamine, N-(3-acetoxyphenyl)-N'-phenyl-p-phenylenediamine, N-(3-acetoxyphenyl)-N'-phenyl-N,N'-dimethyl-p-phenylenediamine, N-(3-acetoxyphenyl)-N'-phenyl-N,N'-diphenyl-p-phenylenediamine, N-(2-acetoxyphenyl)-N'-phenyl-p-phenylenediamine, N-(4-propionyloxyphenyl)-N'-phenyl-p-phenylenediamine, N-(4-benzoyloxyphenyl)-N'-phenyl-p-phenylenediamine, N-(3-benzoyloxyphenyl)-N'-phenyl-p-phenylenediamine, N-(3-β-naphtoyloxyphenyl)-N'-phenyl-p-phenylenediamine, N-(4-methoxycarbonylaminophenyl)-N'-phenyl-p-phenylenediamine, N-(3-methoxycarbonylaminophenyl)-N'-phenyl-p-phenylenediamine, N-(2-methoxycarbonylaminophenyl)-N'-phenyl-p-phenylenediamine, N-(4-ethoxycarbonylaminophenyl)-N'-phenyl-p-phenylenediamine, N-(3-ethoxycarbonylaminophenyl)-N'-phenyl-p-phenylenediamine, N-(4-butoxycarbonylaminophenyl)-N'40 -phenyl-p-phenylenediamine, N-(3-t-butoxycarbonylaminophenyl)-N'-phenyl-p-phenylenediamine, N-(4-phenoxycarbonylaminophenyl)-N'-phenyl-p-phenylenediamine, N-(3-phenoxycarbonylaminophenyl)-N'-phenyl-p-phenylenediamine, N-(4-methoxycarbonyloxyphenyl)-N'-phenyl-p-phenylenediamine, N-(3-methoxycarbonyloxyphenyl)-N'-phenyl-p-phenylenediamine, N-(4-ethoxycarbonyloxyphenyl)-N'-phenyl-p-phenylenediamine, N-(3-ethoxycarbonyloxyphenyl)-N'-phenyl-p-phenylenediamine, N-(4-t-butoxycarbonyloxyphenyl)-N'-phenyl-p-phenylenediamine, N-(3-t-butoxycarbonyloxyphenyl)-N'-phenyl-p-phenylenediamine, N-(4-phenoxycarbonyloxyphenyl)-N'-phenyl-p-phenylenediamine, N-(3-phenoxycarbonyloxyphenyl)-N'-phenyl-p-phenylenediamine, N-(4-methylaminocarbonyloxyphenyl)-N'-phenyl-p-phenylenediamine, N-(4-dimethylaminocarbonyloxyphenyl)-N'-phenyl-p-phenylenediamine, N-(4-phenylaminocarbonyloxyphenyl)-N'-phenyl-p-phenylenediamine, N-(4-tolylaminocarbonyloxyphenyl)-N'-phenyl-p-phenylenediamine, N-(4-methylaminocarbonylaminophenyl)-N'-phenyl-p-phenylenediamine, N-(4-dimethylaminocarbonylaminophenyl)-N'-phenyl-p-phenylenediamine, N-(4-ethylaminocarbonylaminophenyl)-N'-phenyl-p-phenylenediamine, N-(4-diethylaminocarbonylaminophenyl)-N'-phenyl-p-phenylenediamine, N-(4-phenylaminocarbonylaminophenyl)-N'-phenyl-p-phenylenediamine, and N-(4-tolylaminocarbonylaminophenyl)-N'-phenyl-p-phenylenediamine.

Examples in the above case (4), i.e. compounds of the formula (1)-2: sulfonates such as N-[4-(benzenesulfonyloxy)phenyl]-N'-phenyl-p-phenylenediamine, N,N'-dimethyl-N-[4-(benzenesulfonyloxy)phenyl]-N'-phenyl-p-phenylenediamine, N-[4-(toluenesulfonyloxy)phenyl]-N'-phenyl-p-phenylenediamine, N,N'-dimethyl-N-[4-(toluenesulfonyloxy)phenyl]-N'-phenyl-p-phenylenediamine, N-[4-(1-naphthalenesulfonyloxy)phenyl]-N'-phenyl-p-phenylenediamine, N,N'-dimethyl-N-[4-(1-naphthalenesulfonyloxy)phenyl]-N'-phenyl-p-phenylenediamine, N-[4-(2-naphthalenesulfonyloxy)phenyl]-N'-phenyl-p-phenylenediamine, N,N'-dimethyl-N-[4-(2-naphthalenesulfonyloxy)phenyl]-N'-phenyl-p-phenylenediamine, N-[4-(methanesulfonyloxy)phenyl]-N'-phenyl-p-phenylenediamine, N,N'-dimethyl-N-[4-(methanesulfonyloxy)phenyl]-N'-phenyl-p-phenylenediamine, N-[4-(octanesulfonyloxy)phenyl]-N'-phenyl-p-phenylenediamine, and N,N'-dimethyl-N-[4-(octanesulfonyloxy)phenyl]-N'-phenyl-p-phenylenediamine; sulfoamides such as N-[4-benzenesulfonylamino)phenyl]-N'-phenyl-p-phenylenediamine, N,N'-dimethyl-N-[4-(benzenesulfonylamino)phenyl]-N'-phenyl-p-phenylenediamine, N-[4-(toluenesulfonylamino)phenyl]-N'-phenyl-p-phenylenediamine, N,N'-dimethyl-N-[4-toluenesulfonylamino)phenyl]-N'-phenyl-p-phenylenediamine, N-[4-(1-naphthalenesulfonylamino)phenyl]-N'-phenyl-p-phenylenediamine, N,N'-dimethyl-N-[4-(1-naphthalenesulfonylamino)phenyl]-N'-phenyl-p-phenylenediamine, N-[4-(2-naphthalenesulfonylamino)phenyl]-N'-phenyl-p-phenylenediamine, N,N'-dimethyl-N-[4-(2-naphthalenesulfonylamino)phenyl]-N'-phenyl-p-phenylenediamine, N-[4-(methanesulfonylamino)phenyl]-N'-phenyl-p-phenylenediamine, N,N'-dimethyl-N-[4-(methanesulfonylamino)phenyl]-N'-phenyl-p-phenylenediamine, N-[4-(octanesulfonylamino)phenyl]-N'-phenyl-p-phenylenediamine, N,N'-dimethyl-N-[4-(octanesulfonylamino)phenyl]-N'-phenyl-p-phenylenediamine; sulfonates such as N-[3-(benzenesulfonyloxy)phenyl]-N'-phenyl-p-phenylenediamine, N,N'-dimethyl-N-[3-(benzenesulfonyloxy)-phenyl]-N'-phenyl-p-phenylenediamine, N-[3-(toluenesulfonyloxy)phenyl]-N'-phenyl-p-phenylenediamine, N,N'-dimethyl-N-[3(toluenesulfonyloxy)phenyl]9 -N'-phenyl-p-phenylenediamine, N-[3-(1-naphthalenesulfonyloxy)phenyl]-N'-phenyl-p-phenylenediamine, N,N'-dimethyl-N-[3-(1-naphthalenesulfonyloxy)-phenyl]-N'-phenyl-p-phenylenediamine, N-[3-(2-naphthalenesulfonyloxy)phenyl]-N'-phenyl-p-phenylenediamine, N,N'-dimethyl-N-[3-(2-naphthalenesulfonyloxy)-phenyl]-N'-phenyl-p-phenylenediamine, N-[3-(methanesulfonyloxy)phenyl]-N'-phenyl-p-phenylenediamine, N,N'-dimethyl-N-[3-(methanesulfonyloxy)-phenyl]-N'-phenyl-p-phenylenediamine, N-[3-(octanesulfonyloxy)phenyl]-N'-phenyl-p-phenylenediamine, and N,N'-dimethyl-N-[3-(octanesulfonyloxy)-phenyl]-N'-phenyl-p-phenylenediamine; and sulfonamides such as N-[3-(benzenesulfonylamino)phenyl]-N'-phenyl-p-phenylenediamine, N,N'-dimethyl-N-[3-(benezenesulfonylamino)phenyl]-N'-phenyl-p-phenylenediamine, N-[3-(toluenesulfonylamino)-phenyl]-N'-phenyl-p-phenylenediamine, N,N'-dimethyl-N-[3-(toluenesulfonylamino)phenyl]-N'-phenyl-p-phenylenediamine, N-[3-(1-naphthalenesulfonylamino)-phenyl]-N'-phenyl-p-phenylenediamine, N,N'-dimethyl-N-[3-(1-naphthalenesulfonylamino)phenyl]-N'-phenyl-p-phenylenediamine, N-[3-(2-naphthalenesulfonylamino)phenyl]-N'-phenyl-p-phenylenediamine, N,N'-dimethyl-N-[3-(2-naphthalenesulfonylamino)-phenyl]-N'-phenyl-p-phenylenediamine, N-[3-(methanesulfonylamino)phenyl]-N'-phenyl-p-phenylenediamine, N,N'-dimethyl-N-[3-(methanesulfonylamino)phenyl]-N'-phenyl-p-phenylenediamine, N-[3-(octanesulfonylamino)phenyl]-N'-phenyl-p-phenylenediamine, and N,N'-dimethyl-N-[3-(octanesulfonylamino)phenyl]-N'-phenyl-p-phenylenediamine.

Examples in the above case (5), i.e. compounds of the formula (1)-3. N-[4-(trimethylsilyloxy)phenyl]-N'-phenyl-p-phenylenediamine, N,N'-dimethyl-N-[4-(trimethylsilyloxy)phenyl]-N'-phenyl-p-phenylenediamine, N-[4-(triethylsilyloxy)phenyl]-N'-phenyl-p-phenylenediamine, N,N'-dimethyl-N-[4-(triethylsilyloxy)phenyl]-N'-phenyl-p-phenylenediamine, N-[4-(tert-butyldimethylsilyloxy)phenyl]-N'-phenyl-p-phenylenediamine, N,N'-dimethyl-N-[4-(tert-butyldimethylsilyloxy)phenyl]-N'-phenyl-p-phenylenediamine, N-[4-(tert-butylphenylsilyloxy)phenyl]-N'-phenyl-p-phenylenediamine, N,N'-dimethyl-N-[4-(tert-butyldiphenylsilyloxy)phenyl]-N'-phenyl-p-phenylenediamine, N-[3-(trimethylsilyloxy)phenyl]-N'-phenyl-p-phenylenediamine, N,N'-dimethyl-N-[3-(trimethylsilyloxy)phenyl]-N'-phenyl-p-phenylenediamine, N-[3-(triethylsilyloxy)phenyl]-N'-phenyl-p-phenylenediamine, N,N'-dimethyl-N-[3-(triethylsilyloxy)phenyl]-N'-phenyl-p-phenylenediamine, N-[3-(tert-butyldimethylsilyloxy)phenyl]-N'-phenyl-p-phenylenediamine, N,N'-dimethyl-N-[3-(tert-butyldimethylsilyloxy)-phenyl]-N'-phenyl-p-phenylenediamine, N-[3-(tert-butyldiphenylsilyloxy)phenyl]-N'-phenyl-p-phenylenediamine, and N,N'-dimethyl-N-[3-(tert-butyldiphenylsilyloxy)phenyl]-N'-phenyl-p-phenylenediamine.

Examples of the aromatic diamines of the formula (2) are N-acetyl-N'-phenyl-p-phenylenediamine, N-propanoyl-N'-phenyl-p-phenylenediamine, N-butanoyl-N'-phenyl-p-phenylenediamine, N-pentanoyl-N'-phenyl-p-phenylenediamine, N-formyl-N'-phenyl-p-phenylenediamine, N-acryloyl-N'-phenyl-p-phenylenediamine, N-methacryloyl-N'-phenyl-p-phenylenediamine, N-cinnamoyl-N'-phenyl-p-phenylenediamine, N-crotonoyl-N'-phenyl-p-phenylenediamine, N-acetyl-N'-(4-phenylamino)phenyl-p-phenylenediamine, N-acetyl-N'-(4-aminophenyl)-p-phenylenediamine, N-acetyl-N'-(4-(N,N-dimethylamino)phenyl-p-phenylenediamine, and N-phenylacetyl-N'-phenyl-p-phenylenediamine.

The above aromatic diamines may be used alone or in combination.

The aromatic diamine (a) can be produced according to a known method.

For example, the compounds of the formula (1)-1 can be produced by reacting compounds of the formula (1)-11.

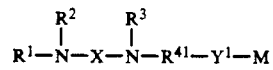

(1)-11 wherein $R^1$, $R^2$, $R^3$, $R^{41}$, X and $Y^1$ are as defined above, and M is a hydrogen atom or an alkali metal, with isocyanate, chloride carbamate, chlorocarbonate ester, dicarbonate diester, a carboxylic acid or acid chloride.

In the formula (1), the $-Y^1-CO-Z$ moiety is a ureido group, a carbamate group, an amido group or an acyloxy group. In the above reaction, isocyanate or chloride carbamate gives ureide or carbamate, chlorocarbonate ester or dicarbonate diester gives carbamate or carbonate, and a carboxylic acid or acid chloride gives an amide or an ester.

The reaction may be carried out optionally in the presence of an acid-scavenger such as a base or a dehydrating agent.

The compounds of the formula (1)-2 can be produced by reacting compounds of the formula (1)-21,

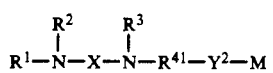

(1)-21 wherein $R^1$, $R^2$, $R^3$, $R^{41}$, X and $Y^2$ are as defined above, and M is a hydrogen atom or an alkali metal, with compounds of the formula (1)-22, $$L-SO_2-R^5,$$

wherein $R^5$ is as defined above, and L is a leaving group such as a halogen atom, in an inert solvent. When a compound of the above formula (1)-21 in which M is a hydrogen atom is used, the above reaction may be carried out in the co-presence of a basic compound, as required.

The compounds of the formula (1)-3 can be produced by reacting compounds of the formula (1)-31,

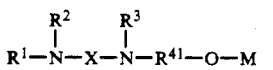

(1)-31 wherein $R^1$, $R^2$, $R^3$, $R^{41}$, X and M are as defined above, with compounds of the formula (1)-32,

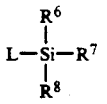

(1)-32 wherein L, $R^6$, $R^7$ and $R^8$ are as defined above, in an inert solvent. When a compound of the above formula (1)-31 in which M is a hydrogen atom is used, it is required to carry out the above reaction in the co-presence of a basic compound.

In the present invention, the color-forming recording material contains an oxidizing agent as a component (b).

The oxidizing agent (b) may be an organic or inorganic oxidizing agent. The organic oxidizing agent is selected from quinoid type electron-accepting compounds; organohalogen compounds; radical-generating compounds such as peroxides; phosphine oxides; sulfoxides; disulfides and N-oxides. The inorganic oxidizing agent is selected from oxygen, halogens, halides, metal oxides and organic acid metal acids. In the present invention, quinoid type electron-accepting compounds are particularly preferred.

Specific examples of the oxidizing agent include silver perchlorate, silver hexafluoroantimonate, silver oxide, silver chloride, cupric chloride, lead oxide, benzoquinone, methylbenzoquinone, naphthoquinone, chloranil, tetrafluorobenzoquinone, dichlorobenzoquinone, anthraquinone, dichlorodicyanobenzoquinone, tetracyanoquinodimethane, N,N'-diphenylquinonediimine, N-chlorosuccinic acid imide, diphenyldisulfide, tribromomethylphenylsulfone, benzoyl peroxide, N-methylmorpholine-N-oxide and m-chloroperbenzoic acid.

As an oxidizing agent (b), in particular, advantageously usable are quinoid type electron-accepting compounds having an LUMO energy level of −2.80 to −1.30 eV, calculated according to the MNDO-PM3 molecular orbital theory (J. J. P. Stewart, J. Comp. Chem. 10, 209, Mopac 6 Ver. 6.0).

The above oxidizing agents (b) may be used alone or in combination.

In the present invention, the color-forming recording material contains an acidic substance as a component (c).

The acidic substance (c) may be an organic or inorganic compound. The organic compound as an acidic substance (c) is selected from phenols such as 2,2-di(4-hydroxyphenyl)propane (bisphenol A), 4,4'-dihydroxydiphenylsulfone (bisphenol S) and 4,4'-dihydroxydiphenylsulfide; aromatic carboxylic acids such as benzoic acid, chlorobenzoic acid, toluic acid, isophthalic acid, terephthalic acid and naphthoic acid; hydroxybenzoic acids such as salicylic acid; aromatic hydroxycarboxylic acids such as hydroxynaphthoic acid; organic sulfonic acids such as p-toluenesulfonic acid, and acidic resins such as phenolic resin, although not limited to these. Of these, aromatic carboxylic acids are particularly preferred.

The inorganic compound as an acidic substance (c) is selected from activated clay, kaolin and clay, and preferably has pKa of not more than 11, particularly preferably not more than 5.

The above acidic substances may be used alone or in combination.

The color-forming recording material of the present invention contains the above components (a), (b) and (c). The above-specified materials for each of the components (a), (b) and (c) may be used alone or in combination.

The oxidizing agent (b) is used in such an amount that the aromatic diamine (a): oxidizing agent (b) molar ratio is preferably 1:100 to 100:1, more preferably 1:20 to 20:1.

The acidic substance (c) is used in such an amount that the aromatic diamine (a): acidic substance (c) molar ratio is preferably 1:100 to 100:1, more preferably 1:20 to 20:1.

The color-forming recording material of the present invention may further contain other known color-forming dye, binder, sensitizer, fluorescent dye, pigment and tackiness preventer as required.

The other color-forming dye is selected, for example, from fluoran compounds, fluorene compounds and phthalide compounds. The combined use of these color-forming dyes permits the intensification of absorption in a near infrared region or adjustment of a hue in a visible light region. Examples of these dyes as a near infrared-absorbing dyestuff are 3-(4'-anilinophenyl)amino-6-methyl-7-anilinofluoran, 3-[4'-(4''-anilinophenyl)aminophenyl]amino-6-methyl-7-chlorofluoran, 3-diethylamino-7-dibenzylaminothiofluoran, 3-diethylamino-7-ethylaminothiofluoran, 3,6-bis(dimethylamino)fluorene-9-spiro-3'-(6'-dimethylamino)phthalide, 3,6-bis(diethylamino)fluorene-9-spiro-3'-(6'-dimethylamino)phthalide, 3,3-bis[1,1-bis(4-dimethylaminophenyl)ethylen-2-yl]phthalide, 3,3-bis[1,1-bis(4-dimethylaminophenyl)ethylen-2-yl]-4,5,6,7-tetrachlorophthalide, 3-(4-dimethylaminophenyl)-3-[1,1-bis(4-dimethylaminophenyl)ethylen-2-yl]phthalide, and 3-(4-dimethylaminophenyl)-3-[1,1-bis(4-dimethylaminophenyl)ethylen-2-yl]dimethylaminophthalide.

Examples of the above dyes as a visible light-absorbing dyestuff are blue color-forming dyes such as Crystal Violet Lactone, Benzoyl Leuco Methylene Blue and Pyridine Blue; green color-forming dyes such as 3-diethylamino-7-octylaminofluoran and 3-diethylamino-7-dibenzylaminofluoran; red color-forming dyes such as 3-cyclohexylamino-6-chlorofluoran, 3-diethylamino-6-methyl-7-chlorofluoran; and black color-forming dyes such as 3-diethylamino-6-methyl-7-anilinofluoran, 3-di-n-butylamino-6-methyl-7-anilinofluoran, 3-diethylamino-7-(o-chloroanilino)fluoran, 3-dibutylamino-7-(o-chloroanilino)fluoran, 3-(N-methyl-N-cyclohexylamino)-6-methyl-7-anilinofluoran, 3-pyrrolidino-6-methyl-7-anilinofluoran, 3-diethylamino-6-chloro-7-anilinofluoran, 3-(N-ethyl-N-isoamylamino)-6-methyl-7-anilinofluoran, and 3-(N-p-tolyl-N-ethylamino)-6-methyl-7-anilinofluoran.

These "other color-forming dyes" are used in such an amount that the aromatic diamine:other color-forming dyes molar ratio is preferably 1:100 to 100:1, preferably 1:20 to 20:1.

The binder is selected, for example, from water-soluble polymers such as polyvinyl alcohol, hydroxyethyl cellulose, sodium polyacrylate, polyvinyl pyrrolidone, and an isobutylene-maleic anhydride copolymer; and latexes of polyvinyl acetate, polyurethane, a styrene-butadiene copolymer, polyacrylic acid and polyacrylate.

The sensitizer is selected, for example, from stearic acid amide, benzamide, dibenzyl terephthalate, diphenyl carbonate, phenyl 1-hydroxy-2-naphthoate, 1-benzyloxynaphthalene and 4,4'-dimethoxydiphenylsulfone. The fluorescent dye is selected, for example, from diaminostilbene, benzimidazole, benzidine, imidazolone and cumalin compounds. The pigment is selected from titanium dioxide, clay, talc, calcium carbonate, aluminum hydroxide, silica, a polystyrene resin and a urea-formalin resin. The tackiness preventer is selected from zinc stearate, calcium stearate and paraffin wax.

The color-forming recording material of the present invention can be used for any one of thermo-sensitive and pressure-sensitive recording materials by a conventional method. For example, a thermo-sensitive recording material is prepared by dispersing the color-forming recording material of the present invention in a solvent, coating the dispersion on a substrate such as paper and drying the coating. The coating amount is generally 1 to 15 g/m$^2$ as a dry weight.

The coating formed of the color-forming recording material as above may be provided with an overcoat layer to protect its recording layer. Before the formation of the above coating, an undercoat layer may be formed in order to smoothen the substrate surface and increase the thermal conductivity efficiency. Further, the back of the substrate may be provided with an adhesive layer for use as a label.

For example, a pressure-sensitive recording paper sheet may be prepared according to a conventional method as a unit comprising a top sheet holding, on its downward surface, microcapsules containing a solution of a color-forming dye and a bottom sheet holding a developer coated on its upward surface, or as a recording paper sheet of which one sheet surface is coated with both such microcapsules and a developer.

The color-forming recording material of the present invention gives a color having practically sufficient intensity immediately after color-forming operation has been carried out, and moreover, the color-formed portion has intense absorption in a wide region from visible light to infrared light. Therefore, the color-forming recording material of the present invention is useful for reading data in a wide wavelength region with apparatus such as bar code reader using a semiconductor laser for reading data in a near infrared region or an apparatus for reading data in a visible light region.

The present invention will be explained further in detail hereinafter by reference to Examples. However, the present invention shall not be limited to these Examples.

EXAMPLES 1-9 AND COMPARATIVE EXAMPLES 1-2

0.0132 Gram of a diamine, 0.0132 g of an oxidizing agent, 0.0264 g of stearic acid amide, 0.066 g of a 10 wt. % polyvinyl alcohol aqueous solution, and 0.145 g of water were treated with a ball mill for 20 hours to give a dispersion A.

Separately, 0.5 g of an acidic substance, 0.3 g of zinc stearate, 0.5 g of a 10 wt. % polyvinyl alcohol aqueous solution, and 5.0 g of water were treated with a ball mill for 20 hours to give a dispersion B.

Then, 1.0 g of the dispersion B was added to the dispersion A to form a coating liquid. And, the coating liquid was coated on a fine paper sheet with a bar coater (PI1210, supplied by Tester Sangyo K.K.), and the resultant coating was air-dried. A bar code print was formed on the resultant sheet with the thermal head of an NEC printer (PC-PR102TL). This bar code was subjected to a reading test with a semiconductor laser (780nm) bar code reader (LS8200, supplied by Symbol Technologies, Inc.) and an LED (660 nm) bar code reader (Touch 7-PC-M10, supplied by Mechanosystems). Table 1 shows the results of the reading test with the semiconductor laser bar code reader.

The diamine, oxidizing agent and acidic substance used in each of Examples 1 to 9 and Comparative Examples 1-2 are as follows.

Diamine (1) N,N'-Diphenyl-p-phenylenediamine
(2) N-(4-Methoxyphenyl)-N'-phenyl-p-phenylenediamine
(3) N-(4-Nitrophenyl)-N'-phenyl-p-phenylenediamine

Oxidizing Agent (a) N,N'-Diphenyl-p-quinonediimine (LUMO −1.54 eV)
(b) N-(4-Methoxyphenyl)-N'-phenyl-p-quinonediimine
(c) Chloranil (LUMO −2.17 eV)
(d) Benzoquinone (LUMO −1.71 eV)
(e) 2,3-Dichloro-5,6-dicyanobenzoquinone
(f) Silver oxide (g) Lead oxide
(h) Nil Acidic Substance (i) 1-Hydroxy-2-naphthoic acid
(ii) Clay
(iii) Nil

TABLE 1

| | Components of color-forming recording material | Number of reading (in 20 times) | |
|---|---|---|---|
| | | Just after color formation | After 24 hours |
| Example | | | |
| 1 | (1)-(a)-(i) | 20 | 20 |
| 2 | (1)-(b)-(i) | 20 | 20 |
| 3 | (2)-(b)-(i) | 20 | 20 |
| 4 | (2)-(c)-(i) | 20 | 20 |
| 5 | (3)-(d)-(i) | 20 | 20 |
| 6 | (1)-(e)-(i) | 20 | 20 |
| 7 | (1)-(f)-(i) | 15 | 14 |
| 8 | (1)-(g)-(i) | 17 | 18 |
| 9 | (1)-(d)-(ii) | 1 | 2 |
| Comparative Example | | | |
| 1 | (1)-(h)-(i) | 0 | 6 |
| 2 | (1)-(c)-(iii) | 0 | 0 |

The bar codes obtained in Examples 1 to 8 were also well readable with the LED bar code reader.

Figure 2:
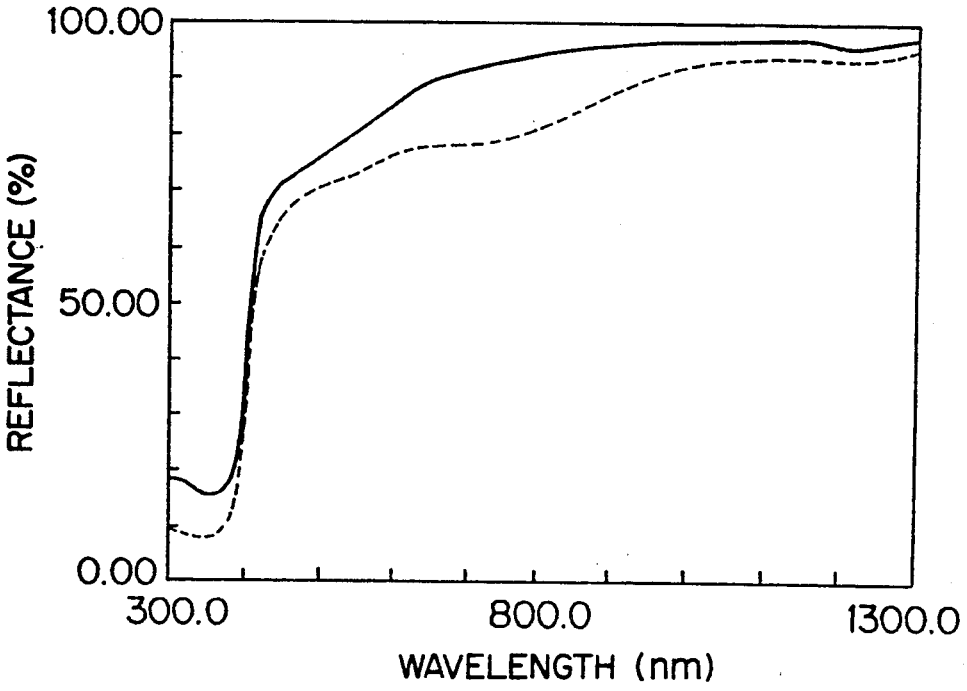
FIG. 2 is a reflection spectrum chart of a color-forming recording material obtained in Comparative Example 1 before and after color formation.

Further, the above color-forming recording materials coated on the same sheets as above were color-formed under heat, using a color-forming tester for thermo-sensitive paper (TH-PMD, supplied by Okura Electric Co., Ltd.). Each of the color-forming materials was measured for reflectance in each of a color-nonformed ground portion (before color formation) and a color-formed portion (after color formation) at 300 to 1,300 nm with a UV measuring apparatus (UV-3101, supplied by Shimadzu Corp.). FIG. 1 shows the reflection spectra of the color-forming recording material obtained in Example 1 in the color-formed portion and the color-nonformed ground portion. FIG. 2 shows the reflection spectra of the color-forming recording material obtained in Comparative Example 1 in the color-formed portion and the color-nonformed ground portion. In these Figures, the solid lines show the reflection spectrum in the color-nonformed ground portion, and the dotted lines show the reflection spectrum in the color-formed portion.

EXAMPLE 10

0.05 Gram of N,N'-diphenyl-p-phenylenediamine, 0.0472 f of chloranil, 0.2178 g of 1-hydroxy-2-naphthoic acid, 0.20 g of stearic acid amide, 0.10 g of zinc stearate, 0.75 g of a 10% polyvinyl alcohol aqueous solution and 1.75 g of water were treated with a mill for 10 minutes to give a coating liquid.

This coating liquid was coated on a fine paper sheet with a bar coater, and after the resultant coating was air-dried, a bar code print was formed thereon. This bar code was readable with both a semiconductor laser bar code reader and an LED bar code reader.

Figure 3:
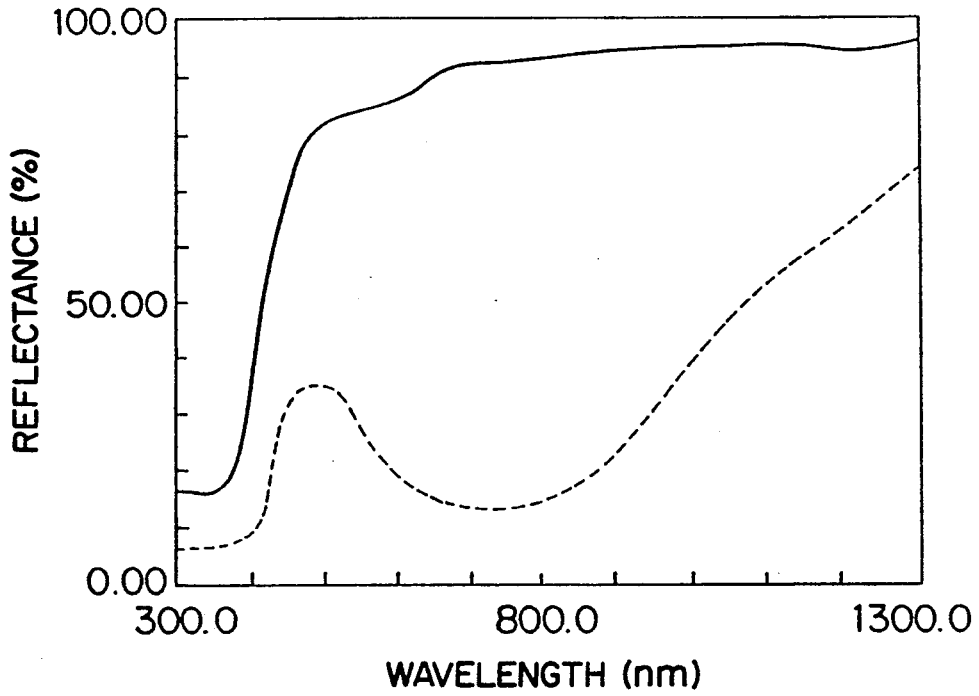
FIG. 3 is a reflection spectrum chart of a color-forming recording material obtained in Example 10 before and after color formation.

The above color-forming recording material coated on the same sheet as above was measured for reflectance before and after the color formation. The color formation was carried out under heat with a color-forming tester for thermo-sensitive paper. FIG. 3 shows the reflection spectra before and after the color formation.

EXAMPLE 11

Figure 4:
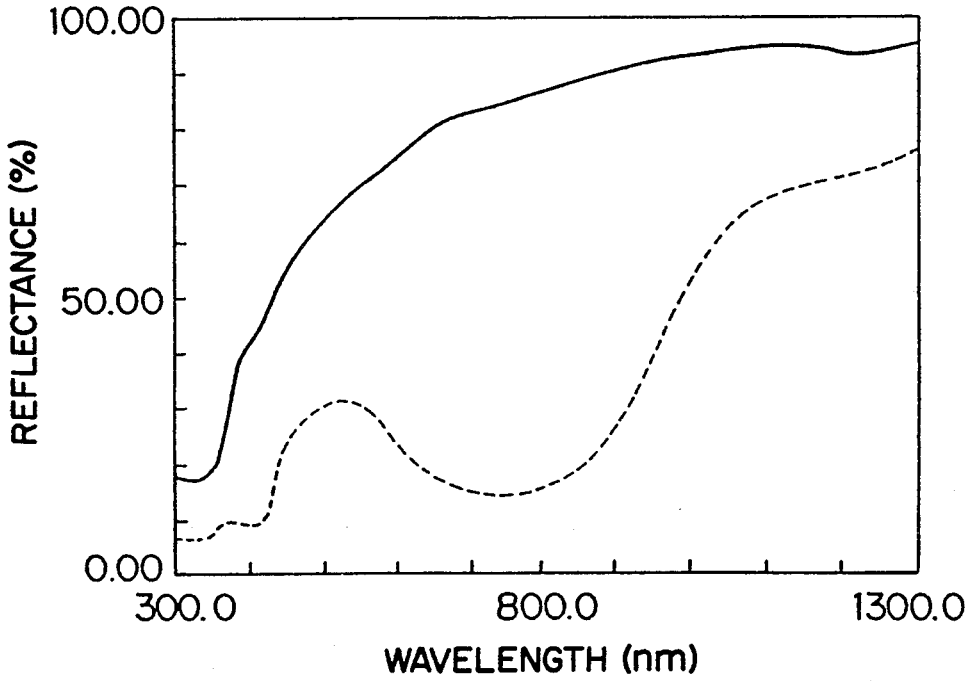
FIG. 4 is a reflection spectrum chart of a color-forming recording material obtained in Example 11 before and after color formation.

Example 10 was repeated except for the use of 0.1993 g of 1-naphthoic acid as an acidic substance to prepare a thermo-sensitive paper sheet, and the thermo-sensitive paper sheet was measured for reflectance before and after the color formation. FIG. 4 shows the reflection spectra before and after the color formation.

EXAMPLE 12

Figure 5:
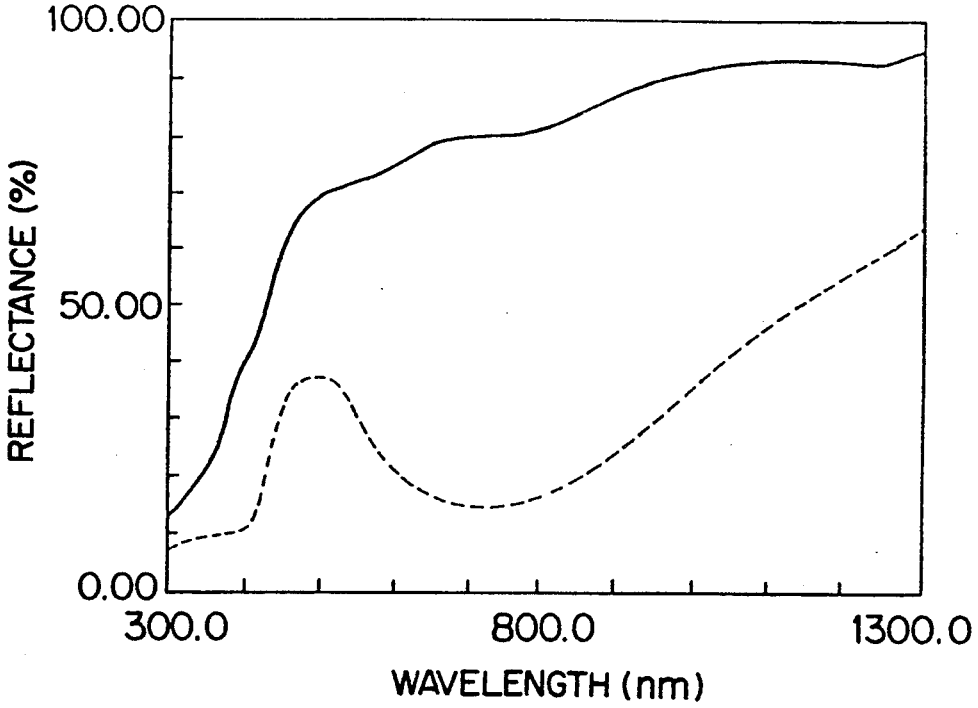
FIG. 5 is a reflection spectrum chart of a color-forming recording material obtained in Example 12 before and after color formation.

Example 10 was repeated except for the use of 0.1923 g of o-phthalic acid as an acidic substance to prepare a thermo-sensitive paper sheet, and the thermo-sensitive paper sheet was measured for reflectance before and after the color formation. FIG. 5 shows the reflection spectra before and after the color formation.

EXAMPLE 13

Figure 6:
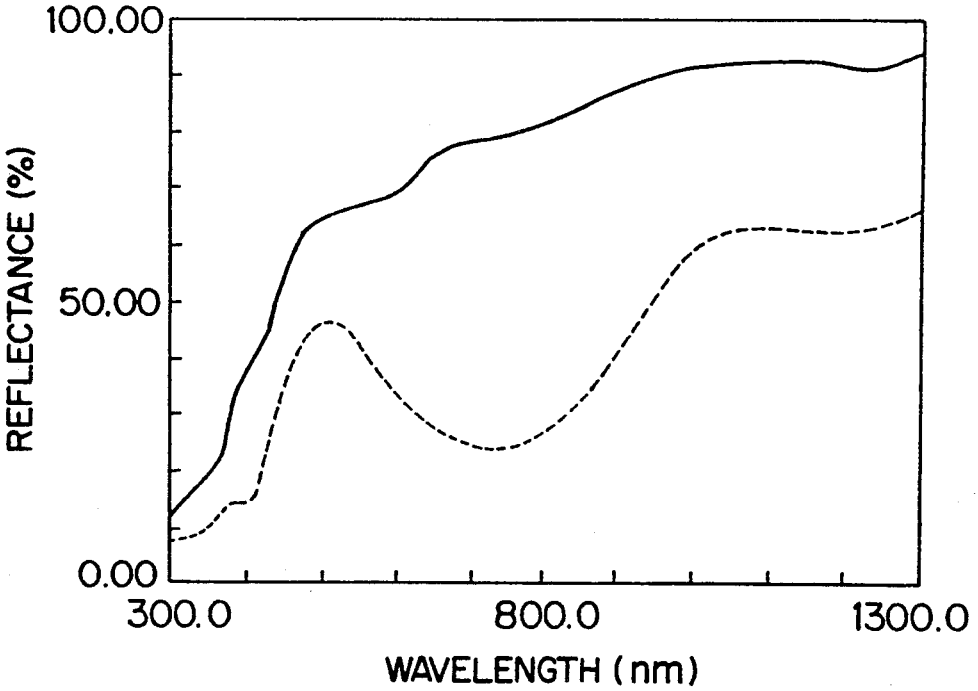
FIG. 6 is a reflection spectrum chart of a color-forming recording material obtained in Example 13 before and after color formation.

Example 10 was repeated except for the use of 0.1842 g of o-chlorobenzoic acid as an acidic substance to prepare a thermo-sensitive paper sheet, and the thermo-sensitive paper sheet was measured for reflectance before and after the color formation. FIG. 6 shows the reflection spectra before and after the color formation.

EXAMPLE 14

Figure 7:
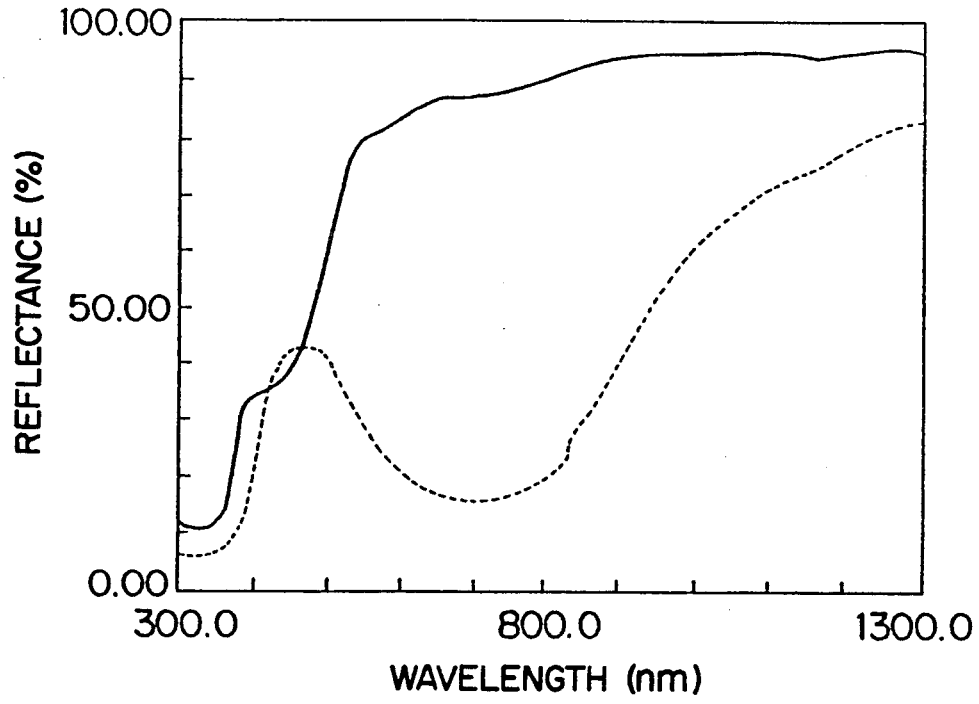
FIG. 7 is a reflection spectrum chart of a color-forming recording material obtained in Example 14 before and after color formation.

Example 10 was repeated except for the use of 0.0207 g of p-benzoquinone as an oxidizing agent to prepare a thermo-sensitive paper sheet, and the thermo-sensitive paper sheet was measured for reflectance before and after the color formation. FIG. 7 shows the reflection spectra before and after the color formation.

EXAMPLE 15

Figure 8:
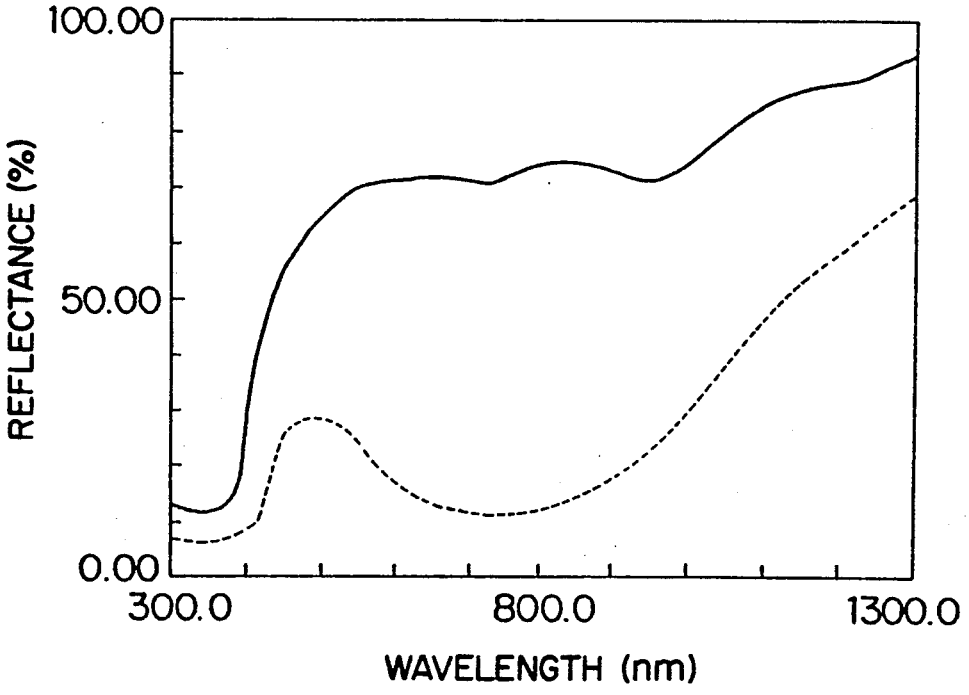
FIG. 8 is a reflection spectrum chart of a color-forming recording material obtained in Example 15 before and after color formation.

Example 10 was repeated except for the use of 0.0566 g of N-(4-chlorophenyl)-N'-phenyl-p-phenylenediamine as a diamine to prepare a thermo-sensitive paper sheet, and the thermo-sensitive paper sheet was measured for reflectance before and after the color formation. FIG. 8 shows the reflection spectra before and after the color formation.

EXAMPLE 16

Figure 9:
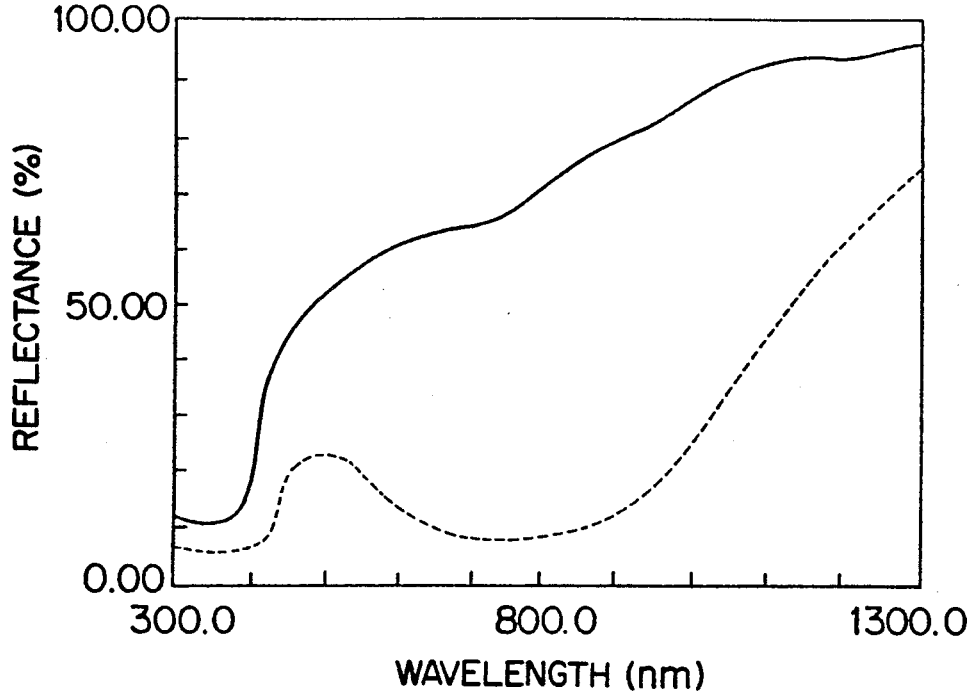
FIG. 9 is a reflection spectrum chart of a color-forming recording material obtained in Example 16 before and after color formation.

Example 10 was repeated except for the use of 0.0527 g of N-p-tolyl-N'-phenyl-p-phenylenediamine as a diamine to prepare a thermo-sensitive paper sheet, and the thermo-sensitive paper sheet was measured for reflectance before and after the color formation. FIG. 9 shows the reflection spectra before and after the color formation.

EXAMPLE 17

Figure 10:
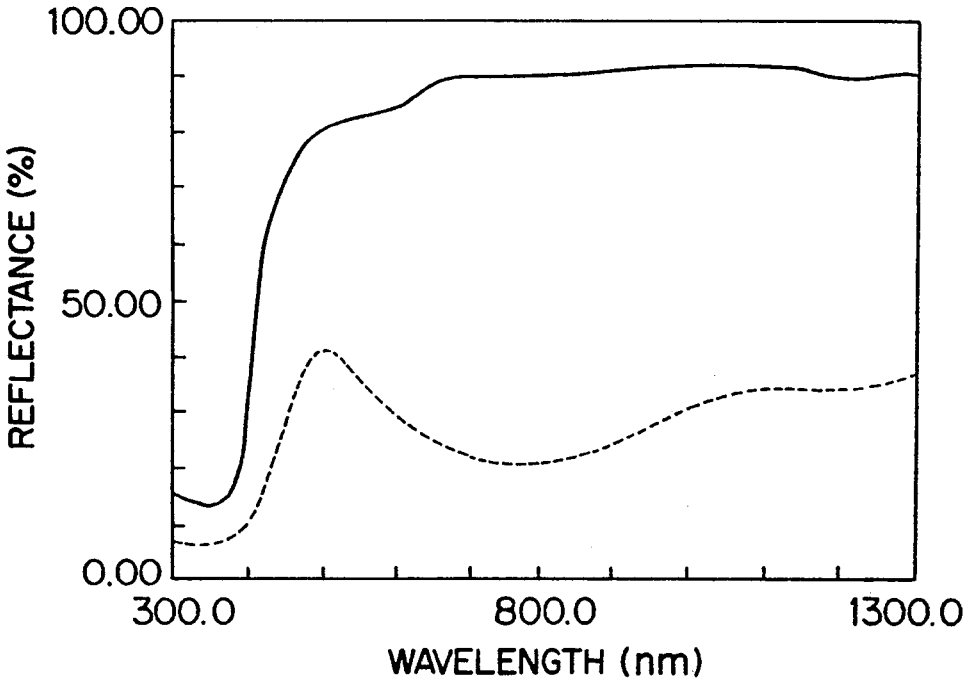
FIG. 10 is a reflection spectrum chart of a color-forming recording material obtained in Example 18 before and after color formation.

Example 10 was repeated except for the use of 0.0558 g of N-(3-methoxyphenyl)-N'-phenyl-p-phenylenediamine as a diamine to prepare a thermo-sensitive paper sheet, and the thermo-sensitive paper sheet was measured for reflectance before and after the color formation. FIG. 10 shows the reflection spectra before and after the color formation.

In each of the above Examples 11 to 17, a bar code print was formed in the same manner as in Example 10. The resultant bar codes were well readable with both a semiconductor laser bar code reader and an LED bar code reader.

EXAMPLE 18

0.0826 Gram of N-[4-(toluenesulfonyloxy)phenyl]-N'-phenyl-p-phenylenediamine, 0.0472 g of chloranil (LUMO −2.17 eV), 0.2178 g of 1-hydroxy-2-naphthoic acid, 0.20 g of stearic acid amide, 0.10 g of zinc stearate, 0.75 g of a 10% polyvinyl alcohol aqueous solution and 1.75 g of water were treated with a planetary type pulverizer (supplied by FRITSCH) for 10 minutes to give a coating liquid.

The above-obtained coating liquid was coated on a fine paper sheet with a bar coater (P11210, supplied by Tester Sangyo K.K.), and air-dried. The color-forming recording material coated on the sheet was measured for reflectance at 300 to 1,300 nm before and after color formation with a UV measuring apparatus (UV-3101, supplied by Shimadzu Corp.). The color formation was carried out under heat with a color-forming tester for thermo-sensitive paper (TH-PMD, supplied by Okura Electric Co., Ltd.).

Figure 11:
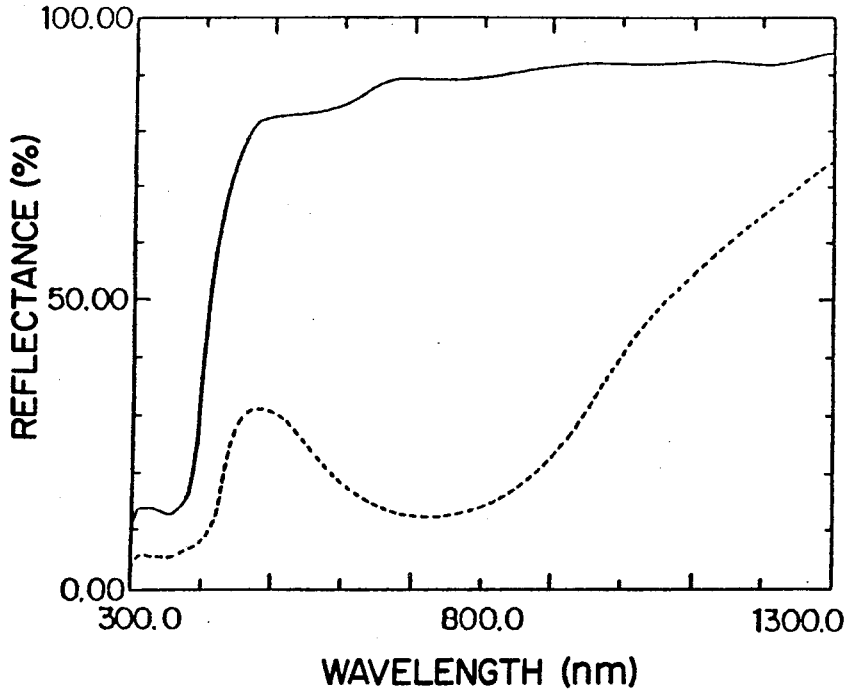
FIG. 11 is a reflection spectrum chart of a color-forming recording material obtained in Example 18 before and after color formation.

FIG. 11 shows the reflection spectra before and after the color formation.

EXAMPLE 19

0.0466 Gram of N-[4-(2-naphthalenesulfonylamino)-phenyl]-N'-phenyl-p-phenylenediamine, 0.0246 g of chloranil, 0.1129 g of 1-hydroxy-2-naphthoic acid, 0.05 g of stearic acid amide, 0.05 g of zinc stearate, 0.40 g of a 10% polyvinyl alcohol aqueous solution and 0.90 g of water were treated with a mill for 10 minutes to give a coating liquid.

Then, in the same manner as in Example 18, the coating liquid was coated on a fine paper sheet with a bar coater, air-dried, and color-formed under heat with a color-forming tester for thermo-sensitive paper.

Figure 12:
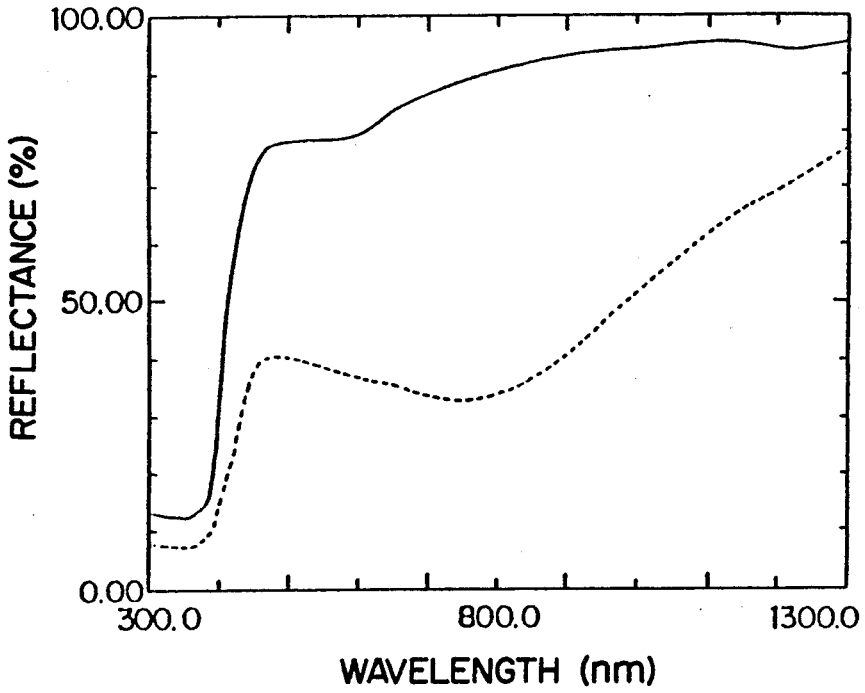
FIG. 12 is a reflection spectrum chart of a color-forming recording material obtained in Example 19 before and after color formation.

FIG. 12 shows the reflection spectra before and after the color formation.

EXAMPLE 20

0.0916 Gram of N,N'-dimethyl-N-[4-toluenesulfonyloxy)phenyl]-N'-phenyl-p-phenylenediamine, 0.0472 g of chloranil, 0.2178 g of 1-hydroxy-2-naphthoic acid, 0.10 g of stearic acid amide, 0.10 g of zinc stearate, 0.75 g of a 10% polyvinyl alcohol aqueous solution and 1.75 g of water were treated with a mill for 10 minutes to give a coating liquid.

Then, in the same manner as in Example 48, the coating liquid was coated on a fine paper sheet with a bar coater, air-dried, and color-formed under heat with a color-forming tester for thermo-sensitive paper.

Figure 13:
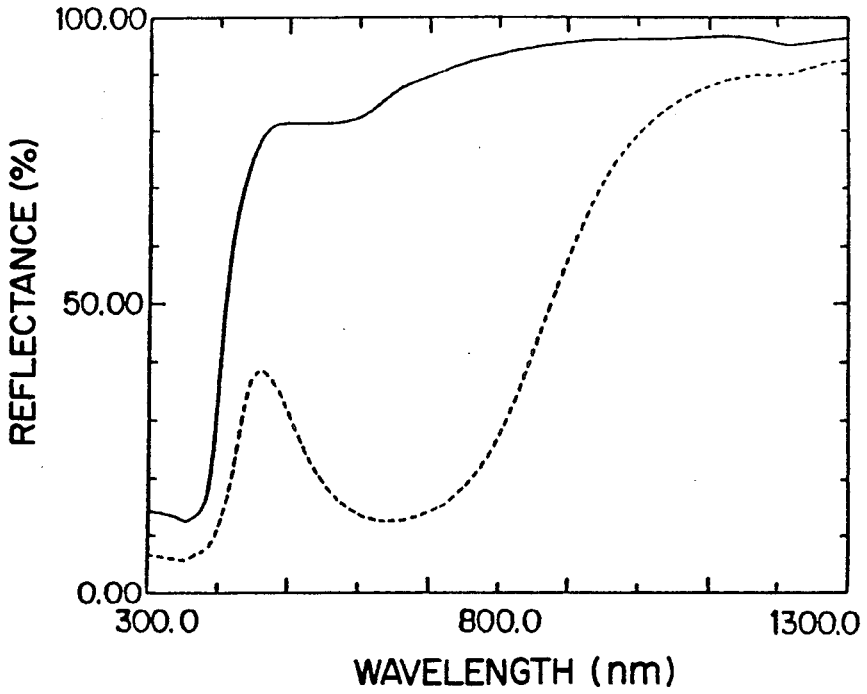
FIG. 13 is a reflection spectrum chart of a color-forming recording material obtained in Example 20 before and after color formation.

FIG. 13 shows the reflection spectra before and after the color formation.

EXAMPLE 21

0.0824 Gram of N-[4-toluenesulfonylamino)phenyl]-N'-phenyl-p-phenylenediamine, 0.0207 g of p-benzoquinone, 0.2178 g of 1-hydroxy-2-naphthoic acid, 0.20 g of stearic acid amide, 0.10 g of zinc stearate, 0.75 g of a 10% polyvinyl alcohol aqueous solution and 1.75 g of water were treated with a mill for 10 minutes to give a coating liquid.

Then, in the same manner as in Example 18, the coating liquid was coated on a fine paper sheet with a bar coater, air-dried, and color-formed under heat with a color-forming tester for thermo-sensitive paper.

Figure 14:
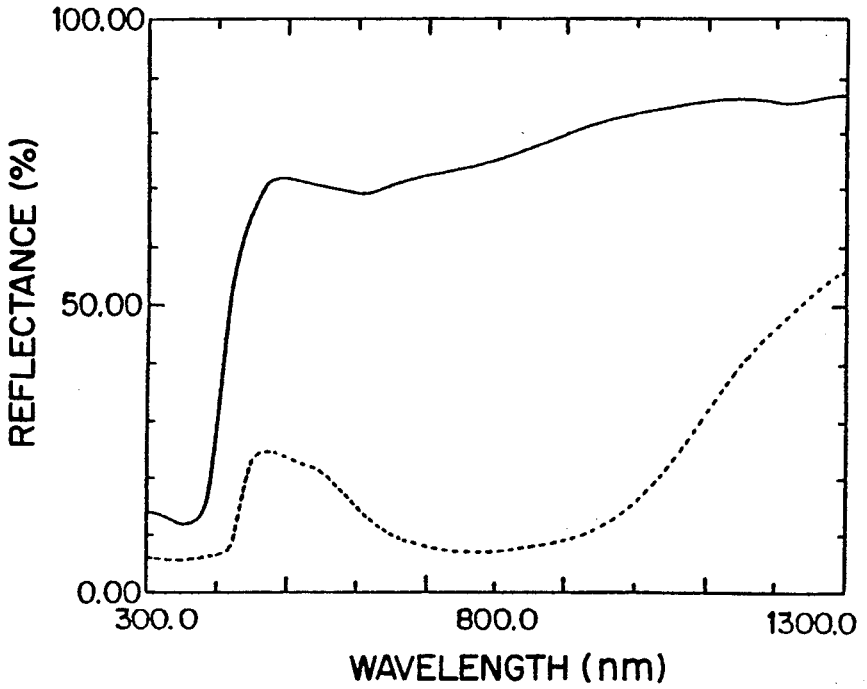
FIG. 14 is a reflection spectrum chart of a color-forming recording material obtained in Example 21 before and after color formation.

FIG. 14 shows the reflection spectra before and after the color formation.

EXAMPLE 22

0.086 Gram of N-[4-toluenesulfonyloxy)phenyl]-N'-phenyl-p-phenylenediamine, 0.0492 g of chloranil, 0.1464 g of benzoic acid, 0.10 g of stearic acid amide, 0.10 g of zinc stearate, 0.8 g of a 10% polyvinyl alcohol aqueous solution and 1.8 g of water were treated with a mill for 10 minutes to give a coating liquid.

Then, in the same manner as in Example 18, the coating liquid was coated on a fine paper sheet with a bar coater, air-dried, and color-formed under heat with a color-forming tester for thermo-sensitive paper.

Figure 15:
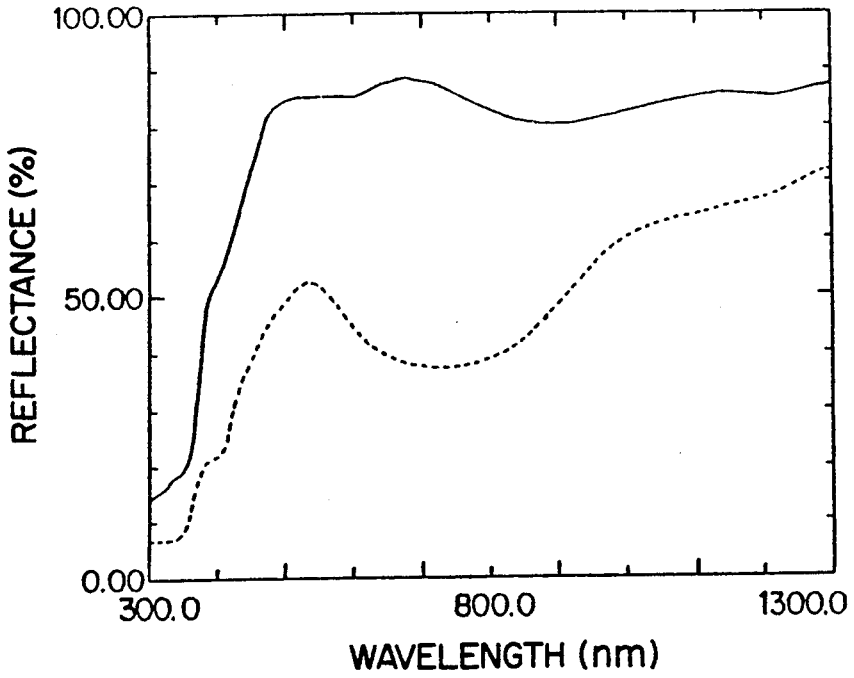
FIG. 15 is a reflection spectrum chart of a color-forming recording material obtained in Example 22 before and after color formation.

FIG. 15 shows the reflection spectra before and after the color formation.

EXAMPLE 23

0.086 Gram of N-[4-toluenesulfonyloxy)phenyl]-N'-phenyl-p-phenylenediamine, 0.0492 g of chloranil, 0.1632 g of o-toluic acid, 0.10 g of stearic acid amide, 0.10 g of zinc stearate, 0.8 g of a 10% polyvinyl alcohol aqueous solution and 1.8 g of water were treated with a mill for 10 minutes to give a coating liquid.

Then, in the same manner as in Example 18, the coating liquid was coated on a fine paper sheet with a bar coater, air-dried, and color-formed under heat with a color-forming tester for thermo-sensitive paper.

Figure 16:
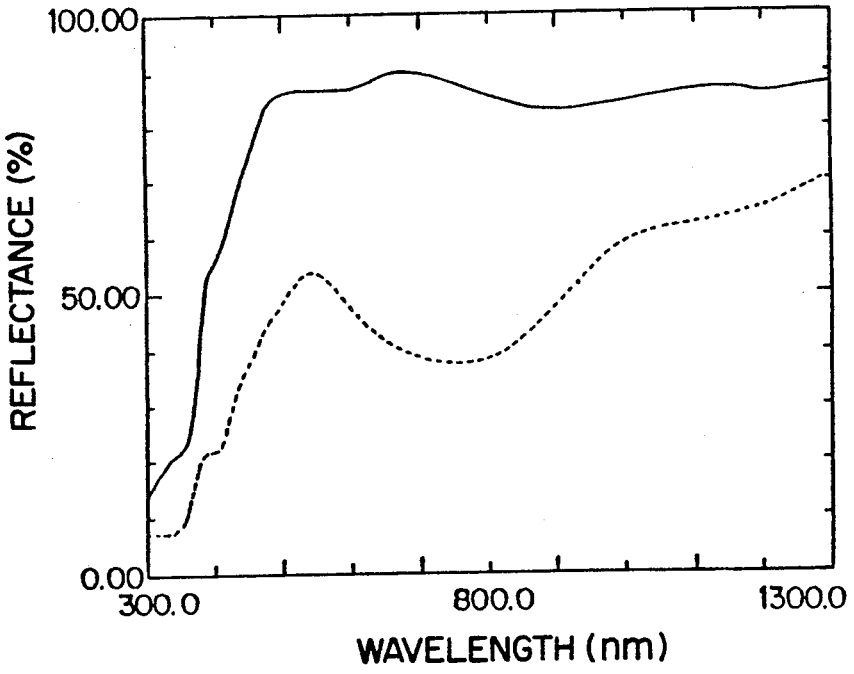
FIG. 16 is a reflection spectrum chart of a color-forming recording material obtained in Example 23 before and after color formation.

FIG. 16 shows the reflection spectra before and after the color formation.

EXAMPLE 24

0.086 Gram of N-[4-toluenesulfonyloxy)phenyl]-N'-phenyl-p-phenylenediamine, 0.0493 g of chloranil, 0.1656 g of salicylic acid, 0.10 g of stearic acid amide, 0.10 g of zinc stearate, 0.8 g of a 10% polyvinyl alcohol aqueous solution and 1.8 g of water were treated with a mill for 10 minutes to give a coating liquid.

Then, in the same manner as in Example 18, the coating liquid was coated on a fine paper sheet with a bar coater, air-dried, and color-formed under heat with a color-forming tester for thermo-sensitive paper.

Figure 17:
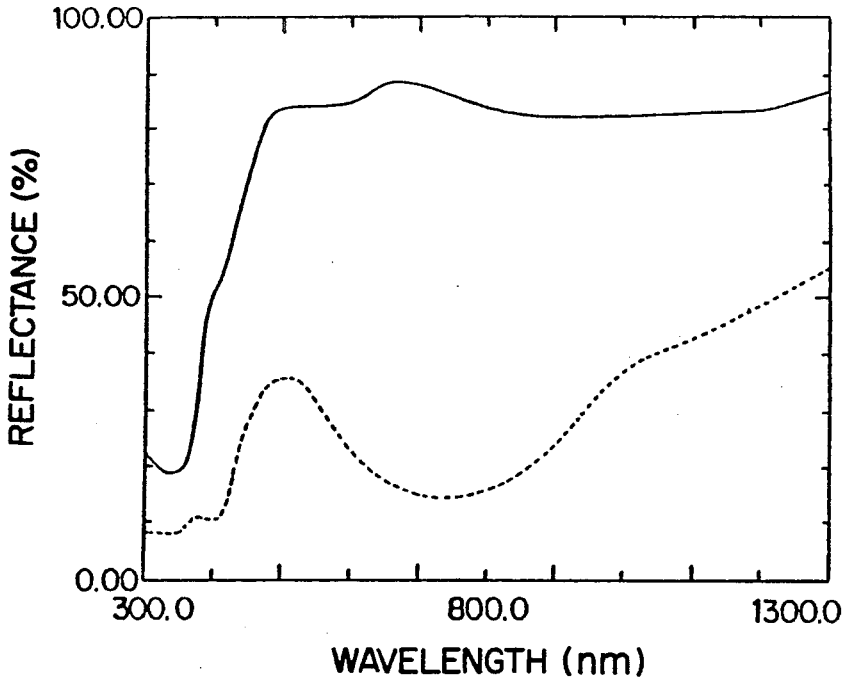
FIG. 17 is a reflection spectrum chart of a color-forming recording material obtained in Example 24 before and after color formation.

FIG. 17 shows the reflection spectra before and after the color formation.

EXAMPLE 25

0.086 Gram of N-[4-toluenesulfonyloxy)phenyl]-N'-phenyl-p-phenylenediamine, 0.0492 g of chloranil, 0.1992 g of isophthalic acid, 0.10 g of stearic acid amide, 0.10 g of zinc stearate, 0.8 g of a 10% polyvinyl alcohol aqueous solution and 1.8 g of water were treated with a mill for 10 minutes to give a coating liquid.

Then, in the same manner as in Example 18, the coating liquid was coated on a fine paper sheet with a bar coater, air-dried, and color-formed under heat with a color-forming tester for thermo-sensitive paper.

Figure 18:
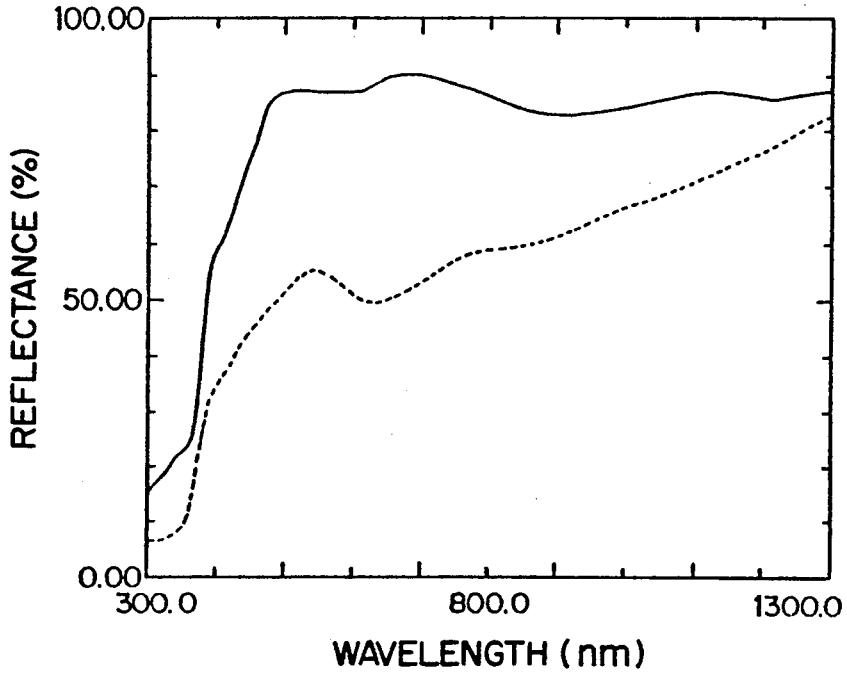
FIG. 18 is a reflection spectrum chart of a color-forming recording material obtained in Example 25 before and after color formation.

FIG. 18 shows the reflection spectra before and after the color formation.

EXAMPLE 26

0.0858 Gram of N-[3-toluenesulfonylamino)phenyl]-N'-phenyl-p-phenylenediamine, 0.0490 g of chloranil, 0.2175 g of 1-hydroxy-2-naphthoic acid, 0.20 g of stearic acid amide, 0.10 g of zinc stearate, 0.75 g of a 10% polyvinyl alcohol aqueous solution and 1.75 g of water were treated with a mill for 10 minutes to give a coating liquid.

Then, in the same manner as in Example 18, the coating liquid was coated on a fine paper sheet with a bar coater, air-dried, and color-formed under heat with a color-forming tester for thermo-sensitive paper.

Figure 19:
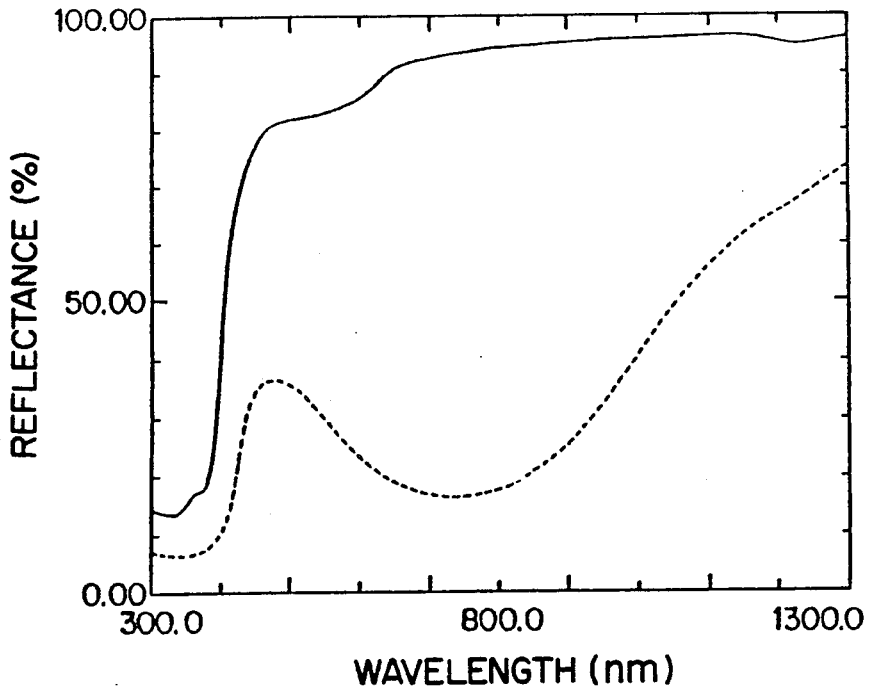
FIG. 19 is a reflection spectrum chart of a color-forming recording material obtained in Example 26 before and after color formation.

FIG. 19 shows the reflection spectra before and after the color formation.

EXAMPLE 27

0.0914 Gram of N,N'-dimethyl-N-[4-toluenesulfonylamino)phenyl]-N'-phenyl-p-phenylenediamine, 0.0495 g of chloranil, 0.2181 g of 1-hydroxy-2-naphthoic acid, 0.20 g of stearic acid amide, 0.10 g of zinc stearate, 0.75 g of a 10% polyvinyl alcohol aqueous solution and 1.75 g of water were treated with a mill for 10 minutes to give a coating liquid.

Then, in the same manner as in Example 18, the coating liquid was coated on a fine paper sheet with a bar coater, air-dried, and color-formed under heat with a color-forming tester for thermo-sensitive paper.

Figure 20:
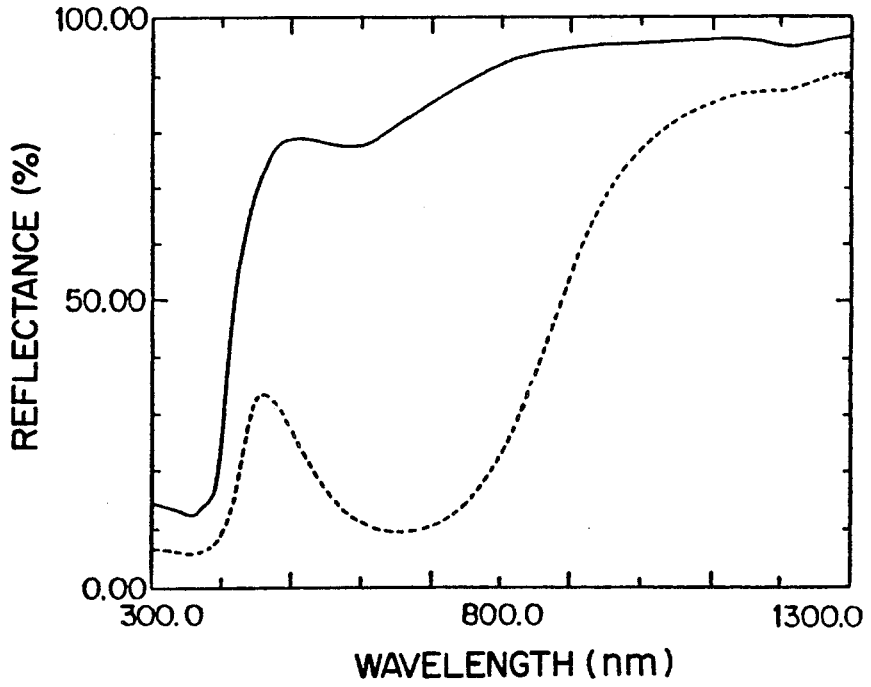
FIG. 20 is a reflection spectrum chart of a color-forming recording material obtained in Example 27 before and after color formation.

FIG. 20 shows the reflection spectra before and after the color formation.

EXAMPLE 28

0.086 Gram of N-[4-toluenesulfonyloxy)phenyl]-N'-phenyl-p-phenylenediamine, 0.036 g of tetrafluoro-1,4-benzoquinone (LUMO −2.70 eV), 0.225 g of 1-hydroxy-2-naphthoic acid, 0.10 g of stearic acid amide, 0.10 g of zinc stearate, 0.8 g of a 10% polyvinyl alcohol aqueous solution and 1.8 g of water were treated with a mill for 10 minutes to give a coating liquid.

Then, in the same manner as in Example 18, the coating liquid was coated on a fine paper sheet with a bar coater, air-dried, and color-formed under heat with a color-forming tester for thermo-sensitive paper.

Figure 21:
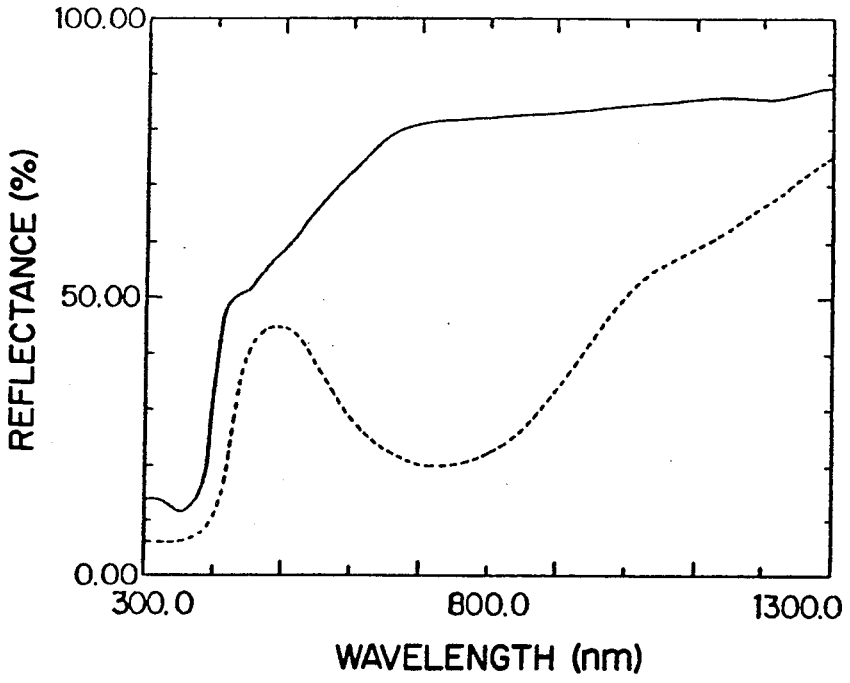
FIG. 21 is a reflection spectrum chart of a color-forming recording material obtained in Example 28 before and after color formation.

FIG. 21 shows the reflection spectra before and after the color formation.

EXAMPLE 29

0.086 Gram of N-[4-toluenesulfonyloxy)phenyl]-N'-phenyl-p-phenylenediamine, 0.035 g of 2,5-dichloro-1,4-benzoquinone (LUMO −1.99 eV), 0.2260 g of 1-hydroxy-2-naphthoic acid, 0.10 g of stearic acid amide, 0.10 g of zinc stearate, 0.8 g of a 10% polyvinyl alcohol aqueous solution and 1.8 g of water were treated with a mill for 10 minutes to give a coating liquid.

Then, in the same manner as in Example 18, the coating liquid was coated on a fine paper sheet with a bar coater, air-dried, and color-formed under heat with a color-forming tester for thermo-sensitive paper.

Figure 22:
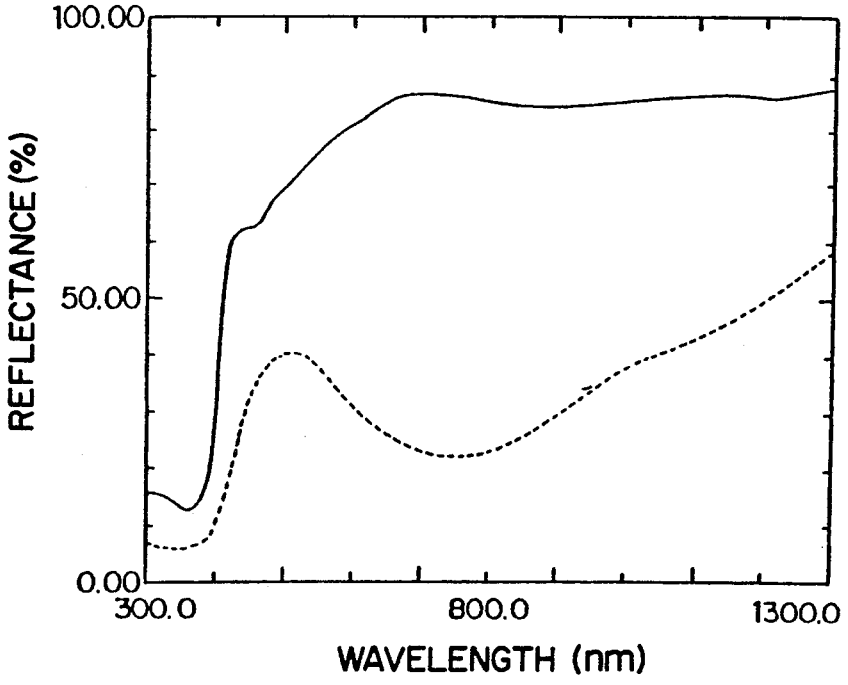
FIG. 22 is a reflection spectrum chart of a color-forming recording material obtained in Example 29 before and after color formation.

FIG. 22 shows the reflection spectra before and after the color formation.

EXAMPLE 30

0.086 Gram of N-[4-toluenesulfonyloxy)phenyl]-N'-phenyl-p-phenylenediamine, 0.0216 g of 1,4-benzoquinone (LUMO −1.71 eV), 0.2259 g of 1-hydroxy-2-naphthoic acid, 0.10 g of stearic acid amide, 0.10 g of zinc stearate, 0.8 g of a 10% polyvinyl alcohol aqueous solution and 1.8 g of water were treated with a mill for 10 minutes to give a coating liquid.

Then, in the same manner as in Example 18, the coating liquid was coated on a fine paper sheet with a bar coater, air-dried, and color-formed under heat with a color-forming tester for thermo-sensitive paper.

Figure 23:
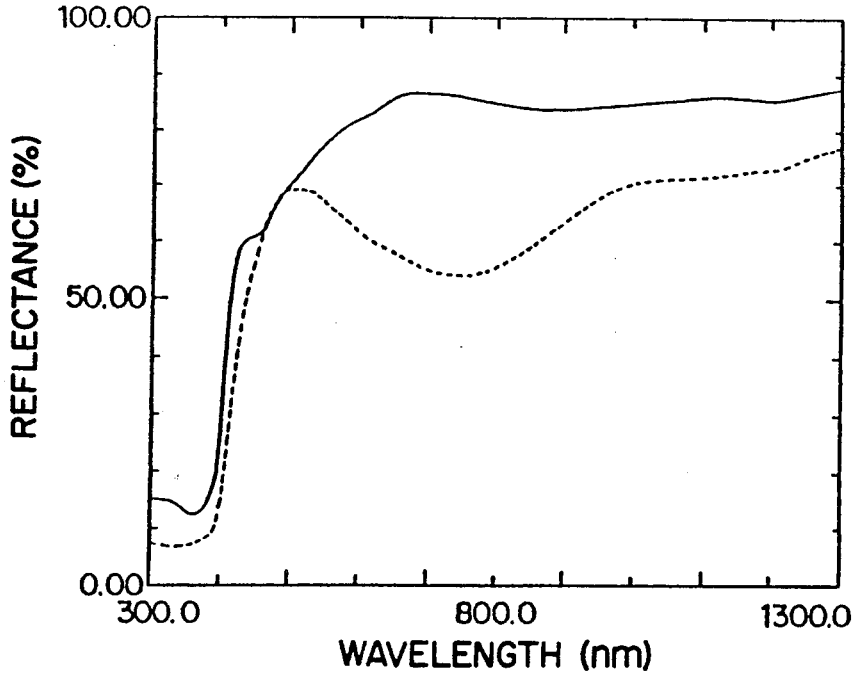
FIG. 23 is a reflection spectrum chart of a color-forming recording material obtained in Example 30 before and after color formation.

FIG. 23 shows the reflection spectra before and after the color formation.

EXAMPLE 31

0.086 Gram of N-[4-toluenesulfonyloxy)phenyl]-N'-phenyl-p-phenylenediamine, 0.0244 g of 2-methyl-1,4-benzoquinone (LUMO −1.65 eV), 0.2257 g of 1-hydroxy-2-naphthoic acid, 0.10 g of stearic acid amide, 0.10 g of zinc stearate, 0.8 g of a 10% polyvinyl alcohol aqueous solution and 1.8 g of water were treated with a mill for 10 minutes to give a coating liquid.

Then, in the same manner as in Example 18, the coating liquid was coated on a fine paper sheet with a bar coater, air-dried, and color-formed under heat with a color-forming tester for thermo-sensitive paper.

Figure 24:
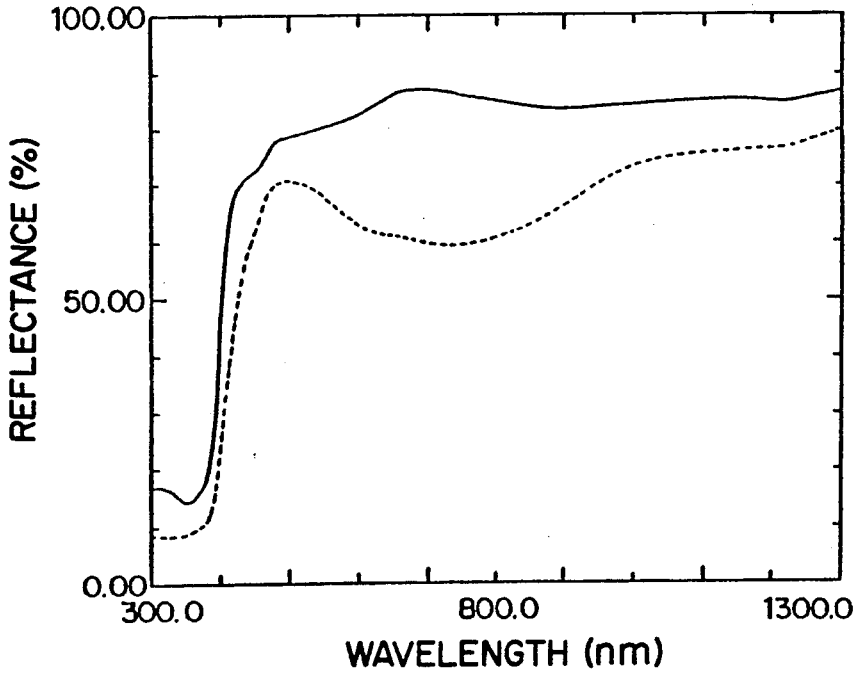
FIG. 24 is a reflection spectrum chart of a color-forming recording material obtained in Example 31 before and after color formation.

FIG. 24 shows the reflection spectra before and after the color formation.

EXAMPLE 32

0.086 Gram of N-[4-toluenesulfonyloxy)phenyl]-N'-phenyl-p-phenylenediamine, 0.0416 g of anthraquinone (LUMO −1.39 eV), 0.2261 g of 1-hydroxy-2-naphthoic acid, 0.10 g of stearic acid amide, 0.10 g of zinc stearate, 0.8 g of a 10% polyvinyl alcohol aqueous solution and 1.8 g of water were treated with a mill for 10 minutes to give a coating liquid.

Then, in the same manner as in Example 18, the coating liquid was coated on a fine paper sheet with a bar coater, air-dried, and color-formed under heat with a color-forming tester for thermo-sensitive paper.

Figure 25:
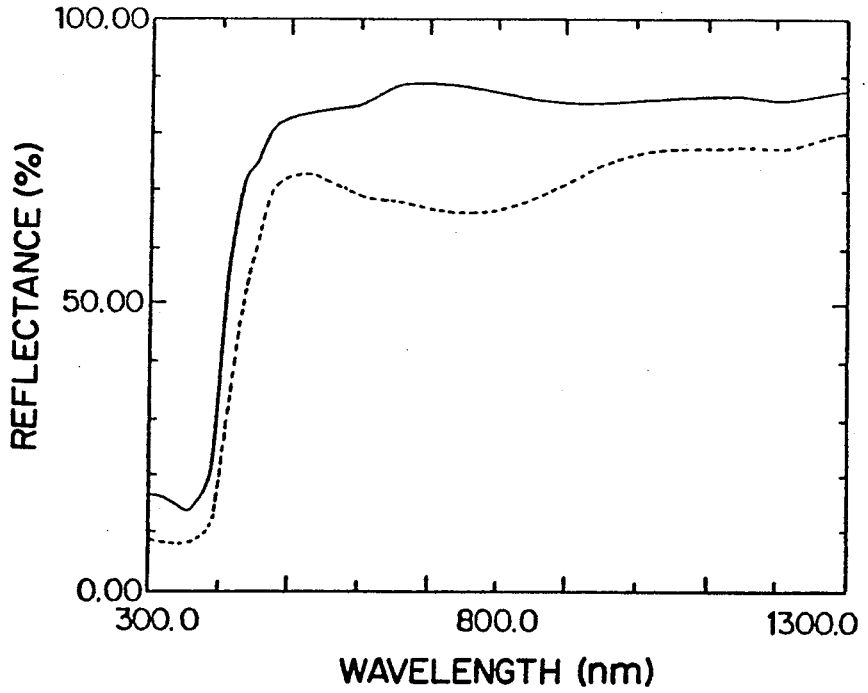
FIG. 25 is a reflection spectrum chart of a color-forming recording material obtained in Example 32 before and after color formation.

FIG. 25 shows the reflection spectra before and after the color formation.

A bar code print was formed on each of thermo-sensitive paper sheets obtained in Examples 18 to 32 with the thermal head of an NEC printer (PC-PR102TL). These bar codes were all readable with both a semiconductor laser (780 nm) bar code reader (LS8200, supplied by Symbol Technologies, Inc.) and an LED bar code reader (M10, supplied by Mechanosystems).

EXAMPLE 33

Figure 26:
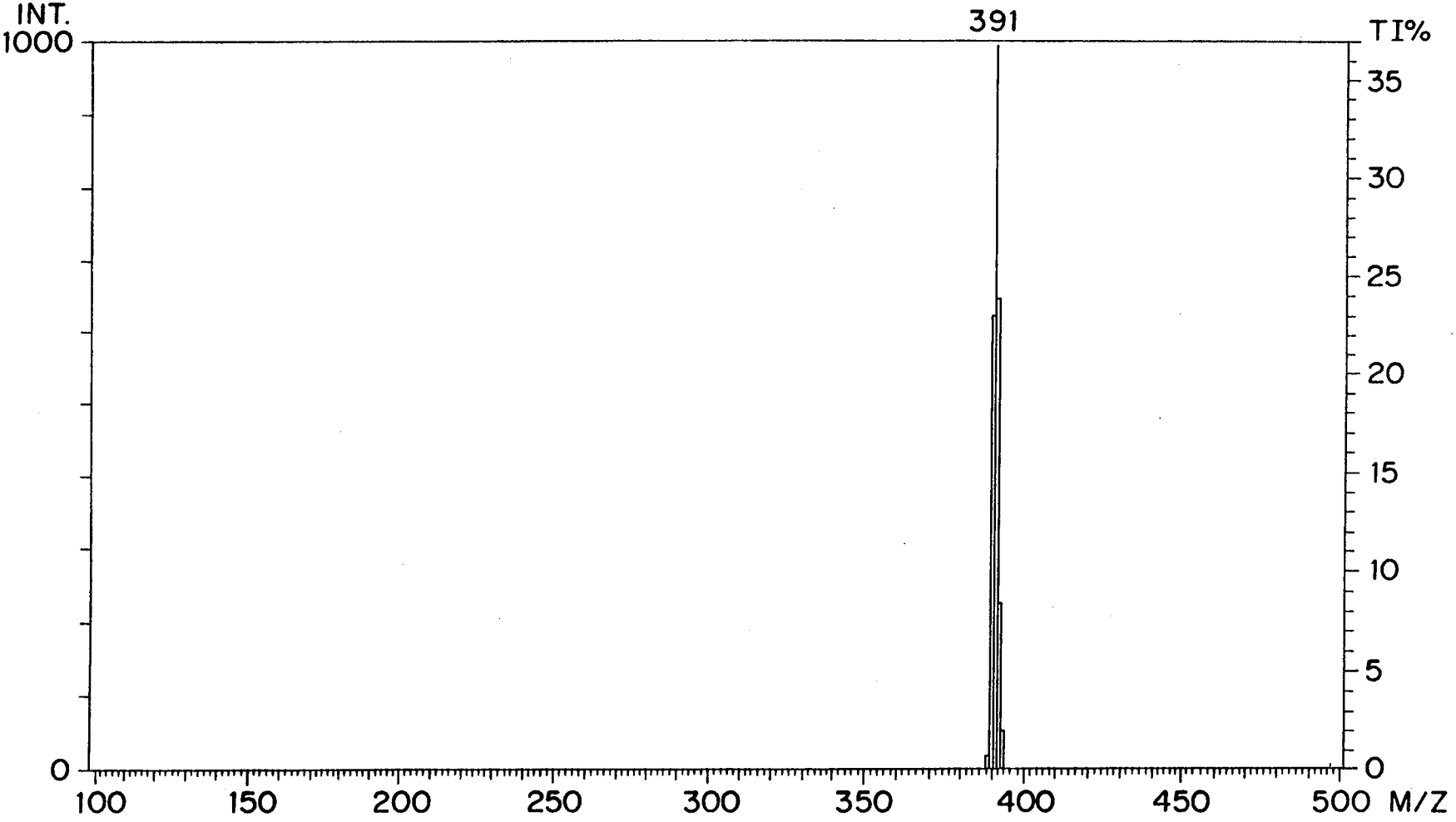
FIG. 26 is a mass spectrum chart of an aromatic diamine used in Example 33.

0.0749 Gram of N-[4-(tert-butyldimethylsilyloxy)-phenyl]-N'-phenyl-p-phenylenediamine having a mass spectrum shown in FIG. 26, 0.0472 g of chloranil, 0.2178 g of 1-hydroxy-2-naphthoic acid, 0.20 g of stearic acid amide, 0.10 g of zinc stearate, 0.75 g of a 10% polyvinyl alcohol aqueous solution and 1.75 g of water were treated with a planetary type pulverizer (supplied by FRITSCH) for 10 minutes to give a coating liquid.

The above-obtained coating liquid was coated on a fine paper sheet with a bar coater (P11210, supplied by Tester Sangyo K. K.), and air-dried. The color-forming recording material coated on the sheet was measured for reflectance at 300 to 1,300 nm before and after color formation with a UV measuring apparatus (UV-3101, supplied by Shimadzu Corp.). The color formation was carried out under heat with a color-forming tester for thermo-sensitive paper (TH-PMD, supplied by Okura Electric Co., Ltd.).

Figure 27:
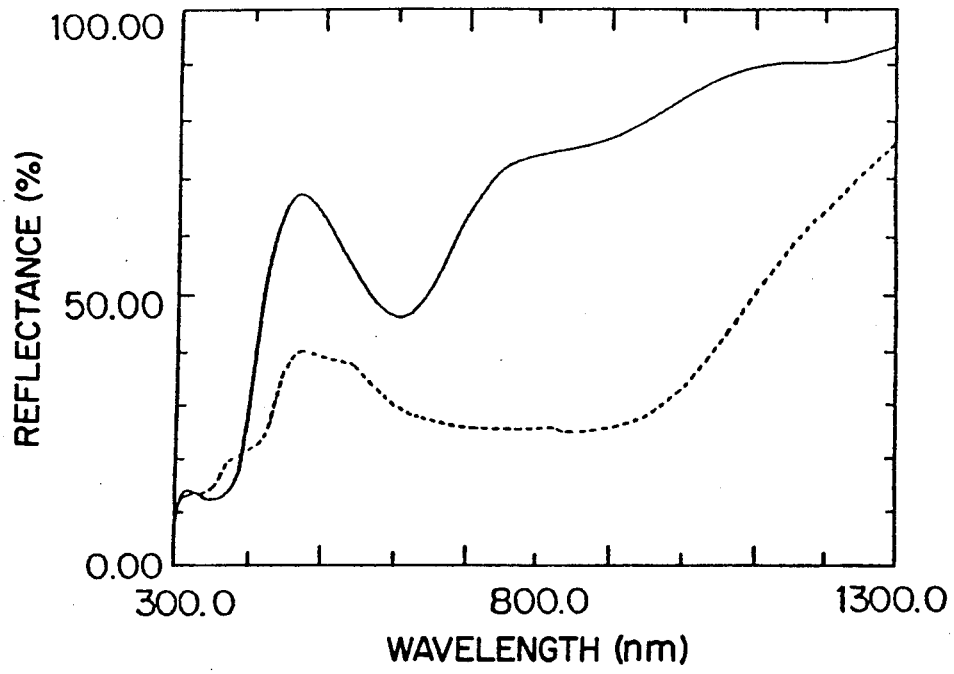
FIG. 27 is a reflection spectrum chart of a color-forming recording material obtained in Example 33 before and after color formation.

FIG. 27 shows the reflection spectra before and after the color formation.

A bar code print was formed on the thermo-sensitive paper sheet obtained in Example 33 with the thermal head of an NEC printer (PC-PR102TL). The bar code was readable with both a semiconductor laser (780 nm) bar code reader (LS8200, supplied by Symbol Technologies, Inc.) and an LED bar code reader (M10, supplied by Mechanosystems).

EXAMPLE 34

0.0435 Gram of N-acetyl-N'-phenyl-p-phenylenediamine, 0.0472 g of chloranil, 0.2178 g of 1-hydroxy-2-naphthoic acid, 0.10 g of stearic acid amide, 0.10 g of zinc stearate, 0.75 g of a 10% polyvinyl alcohol aqueous solution and 1.75 g of water were treated with a planetary type pulverizer (supplied by FRITSCH) for 10 minutes to give a coating liquid.

Then, the above-obtained coating liquid was coated on a fine paper with a bar coater (P11210, supplied by Tester Sangyo K. K.), and air-dried. The color-forming recording material coated on the sheet was measured for reflectance at 300 to 1,300 nm before and after color formation with a UV measuring apparatus (UV-3101, supplied by Shimadzu Corp.). The color formation was carried out under heat with a color-forming tester for thermo-sensitive paper (TH-PMD, supplied by Okura Electric Co., Ltd.).

EXAMPLE 35

0.0555 Gram of N-benzoyl-N'-phenyl-p-phenylenediamine, 0.0472 g of chloranil, 0.2178 g of 1-hydroxynaphthoic acid, 0.10 g of stearic acid amide, 0.10 g of zinc stearate, 0.75 g of a 10% polyvinyl alcohol aqueous solution and 1.75 g of water were treated with a mill for 10 minutes to give a coating liquid.

Then, in the same manner as in Example 34, the above-obtained coating liquid was coated on a fine paper sheet and air-dried. The color-forming recording material coated on the sheet was color-formed with a color-forming tester for thermo-sensitive paper.

A bar code print was formed on each of the thermo-sensitive paper sheets obtained in Examples 34 and 35 with the thermal head of an NEC printer (PC-PR102TL). These bar codes were readable with both a semiconductor laser (780 nm) bar code reader (LS8200, supplied by Symbol Technologies, Inc.) and an LED bar code reader (M10, supplied by Mechanosystems).

EXAMPLE 36

0.0435 Gram of N-acetyl-N'-phenyl-p-phenylenediamine, 0.0435 g of p-benzoquinone, 0.2178 g of 1-hydroxy-2-naphthoic acid, 0.10 g of stearic acid amide, 0.10 g of zinc stearate, 0.75 g of a 10% polyvinyl alcohol aqueous solution and 1.75 g of water were treated with a mill for 10 minutes to give a coating liquid.

Then, in the same manner as in Example 34, the above-obtained coating liquid was coated on a fine paper sheet and air-dried. The color-forming recording material coated on the sheet was color-formed with a color-forming tester for thermo-sensitive paper.

EXAMPLE 37

0.0555 Gram of N-benzoyl-N'-phenyl-p-phenylenediamine, 0.0207 g of p-benzoquinone, 0.2178 g of 1-hydroxy-2-naphthoic acid, 0.20 g of stearic acid amide, 0.10 g of zinc stearate, 0.75 g of a 10% polyvinyl alcohol aqueous solution and 1.73 g of water were treated with a mill for 10 minutes to give a coating liquid.

Then, in the same manner as in Example 34, the above-obtained coating liquid was coated on a fine paper sheet and air-dried. The color-forming recording material coated on the sheet was color-formed with a color-forming tester for thermo-sensitive paper.

A bar code print was also formed on each of the thermo-sensitive paper sheets obtained in Examples 36 and 37, and the so-formed bar codes were readable with both a semiconductor laser bar code reader and an LED bar code reader.

EXAMPLES 38–41 AND COMPARATIVE EXAMPLES 3–4

0.0088 Gram of 3-diethylamino-6-methyl-7-anilinofluoran, 0.0088 g of a diamine derivative, 0.0088 g of a quinoid type electron-accepting compound, 0.0264 g of stearic acid amide, 0.066 g of a 10 wt. % polyvinyl alcohol aqueous solution and 0.145 g of water were treated with a ball mill for 20 hours to give a dispersion A.

Separately, 0.5 g of an acidic substance, 0.3 g of zinc stearate, 1.5 g of a 10 wt. % polyvinyl alcohol aqueous solution and 5.0 g of water were treated with a ball mill for 20 hours to give a dispersion B.

Then, 1.0 g of the dispersion A was added to the dispersion B, and the resultant mixture was coated on a fine paper sheet with a bar coater and air-dried. And, a bar code print was formed on the sheet with the thermal head of an NEC printer (PC-PR102TL). The bar code was read with a semiconductor laser (780 nm) bar code reader supplied by Symbol Technologies, Inc. Table 2 shows the results.

The diamine derivative, quinoid type electron-accepting compound and acidic substance used in each of Examples 38 to 41 and Comparative Examples 3 and 4 are as follows.

Diamine Derivative (1) N,N'-Diphenyl-p-phenylenediamine
(2) N-(4-Methoxyphenyl)-N'-phenyl-p-phenylenediamine
(3) N-(2-Methyl-4-methoxyphenyl)-N'-phenyl-p-phenylenediamine
(4) Nil

Quinoid Type Electron-Accepting Compound (a) N,N'-Diphenyl-p-quinonediimine (LUMO −1.54 eV)
(b) N-(4-Methoxyphenyl)-N'-phenyl-p-quinonediimine
(c) N-(2-Methyl-4-methoxyphenyl)-N'-phenyl-p-quinonediimine
(d) Nil

Acidic Substance (i) 1-Hydroxy-2-naphthoic acid
(ii) Clay
(iii) Nil

TABLE 2

| | Components of color-forming recording material*) | Number of reading (in 20 times) | |
|---|---|---|---|
| | | 633 nm | nm |
| Example 38 | (1)-(a)-(i) | 20 | 20 |
| Example 39 | (1)-(a)-(ii) | 20 | 2 |
| Comparative Example 3 | (1)-(a)-(iii) | 0 | 0 |
| Comparative Example 4 | (1)-(d)-(i) | 20 | 1 |
| Example 40 | (2)-(b)-(i) | 20 | 20 |
| Example 41 | (3)-(c)-(i) | 20 | 20 |

(Note)
All of the above color-forming recording materials contained a color-forming dye.

Figure 28:
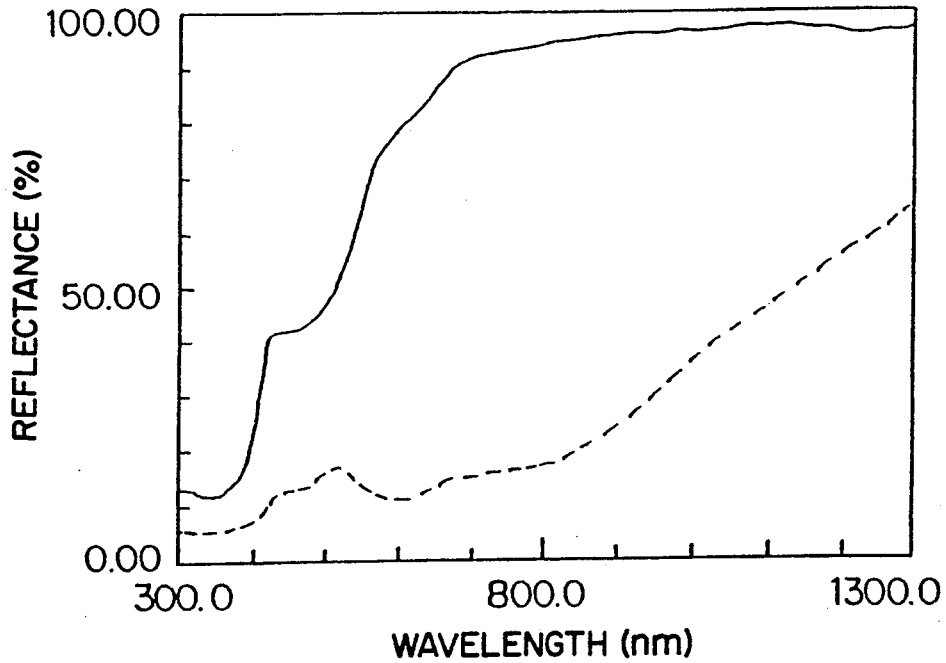
FIG. 28 is a reflection spectrum chart of a color-forming recording material obtained in Example 38 before and after color formation.
Figure 29:
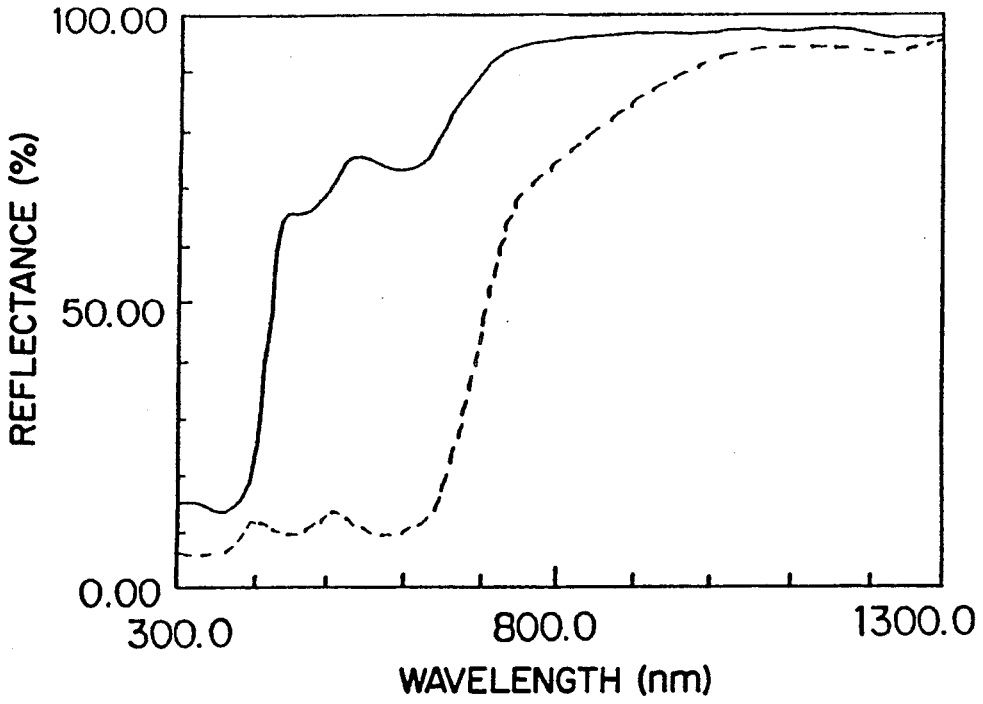
FIG. 29 is a reflection spectrum chart of another color-forming recording material obtained in Comparative Example 4 before and after color formation.
Figure 30:
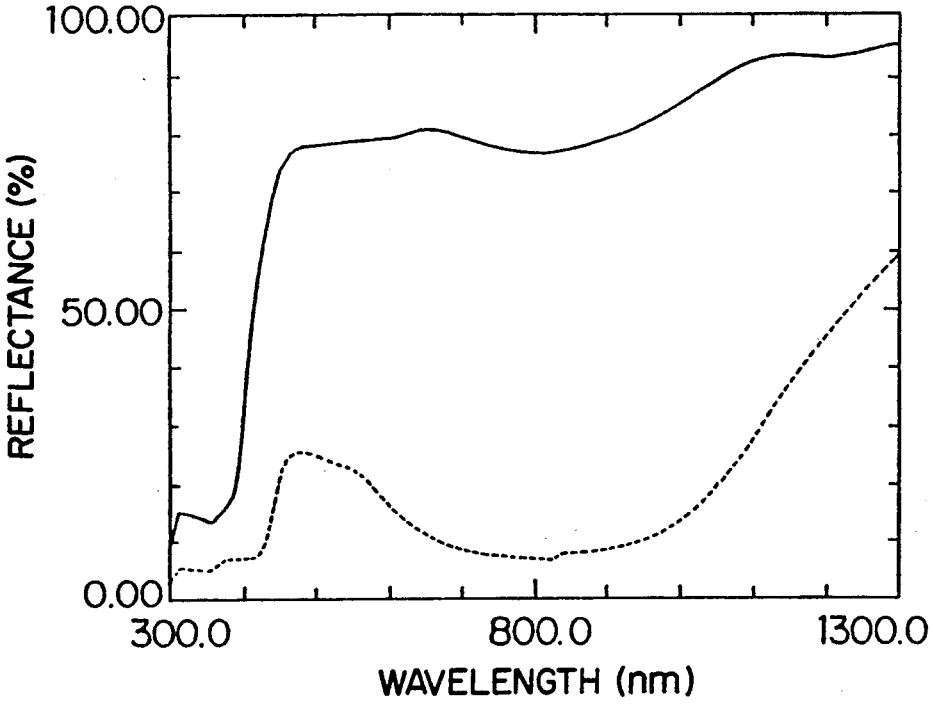
FIG. 30 is a reflection spectrum chart of a color-forming recording material obtained in Example 42 before and after color formation.
Figure 31:
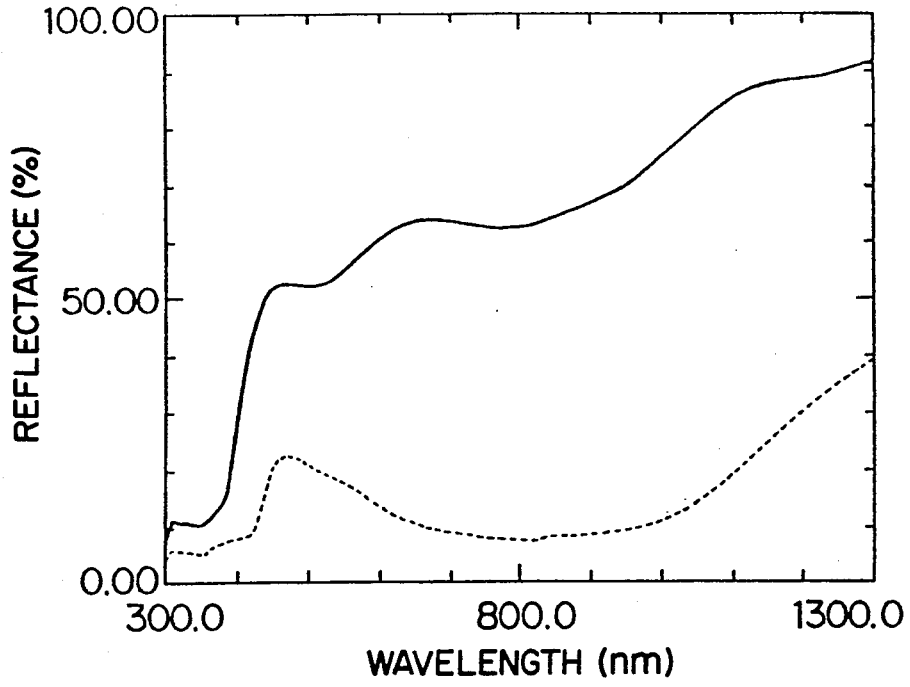
FIG. 31 is a reflection spectrum chart of a color-forming recording material obtained in Example 43 before and after color formation.
Figure 32:
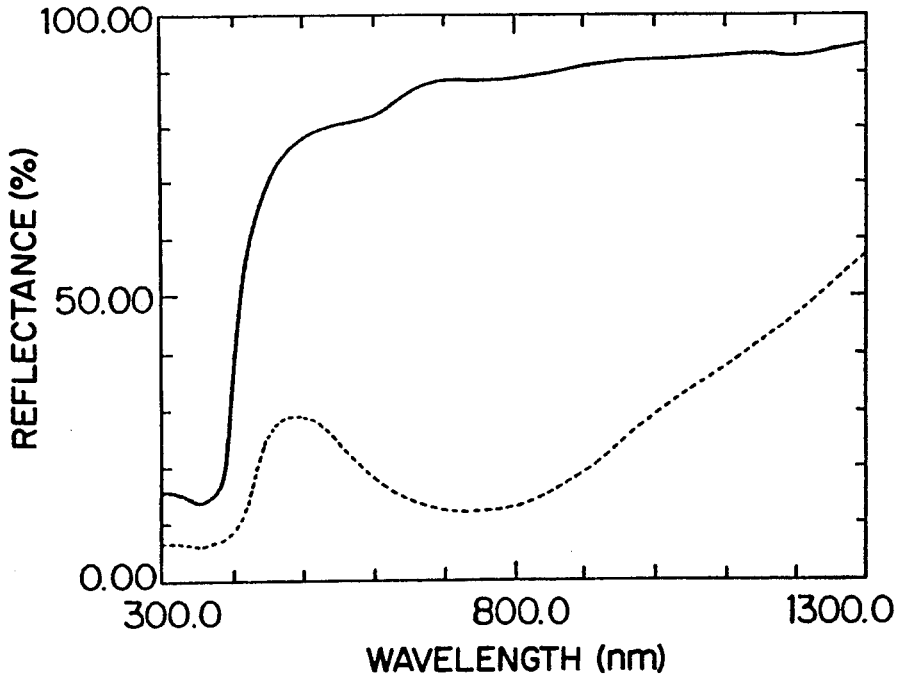
FIG. 32 is a reflection spectrum chart of a color-forming recording material obtained in Example 44 before and after color formation.
Figure 33:
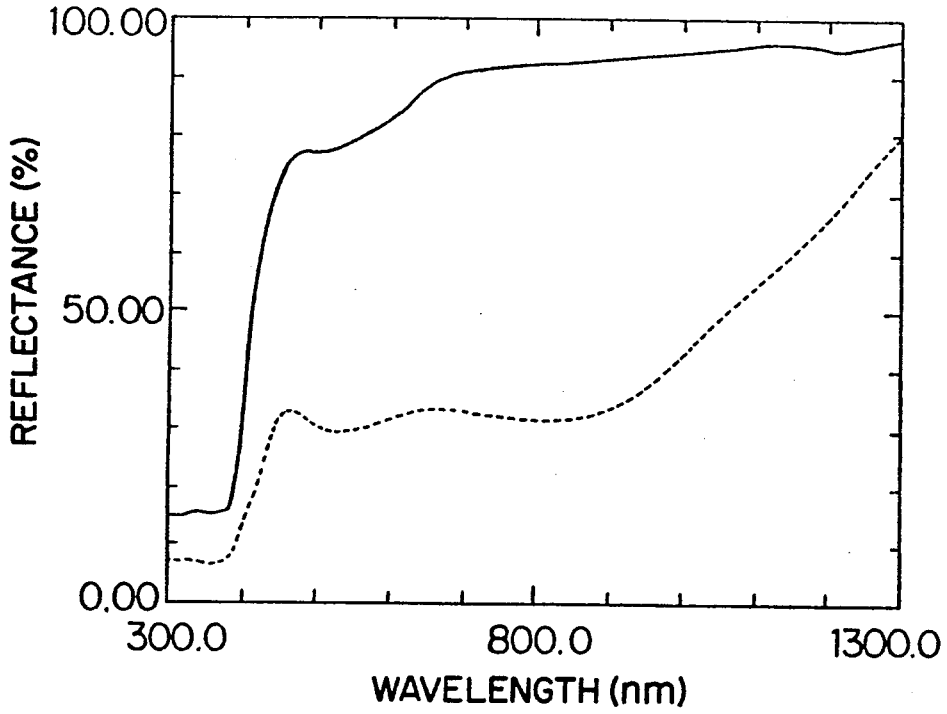
FIG. 33 is a reflection spectrum chart of a color-forming recording material obtained in Example 45 before and after color formation.
Figure 34:
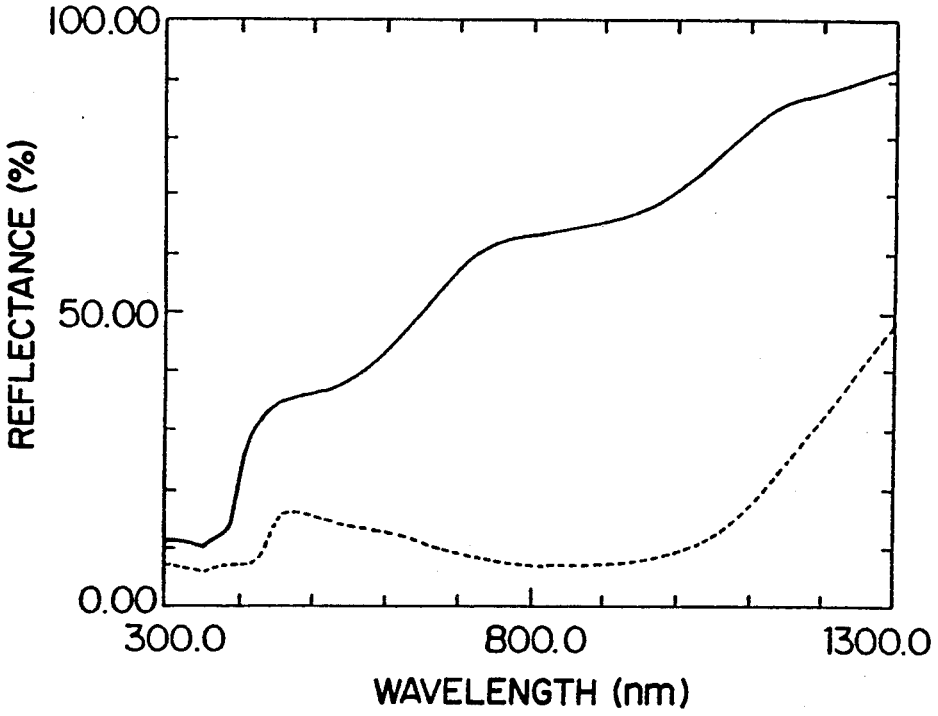
FIG. 34 is a reflection spectrum chart of a color-forming recording material obtained in Example 46 before and after color formation.
Figure 35:
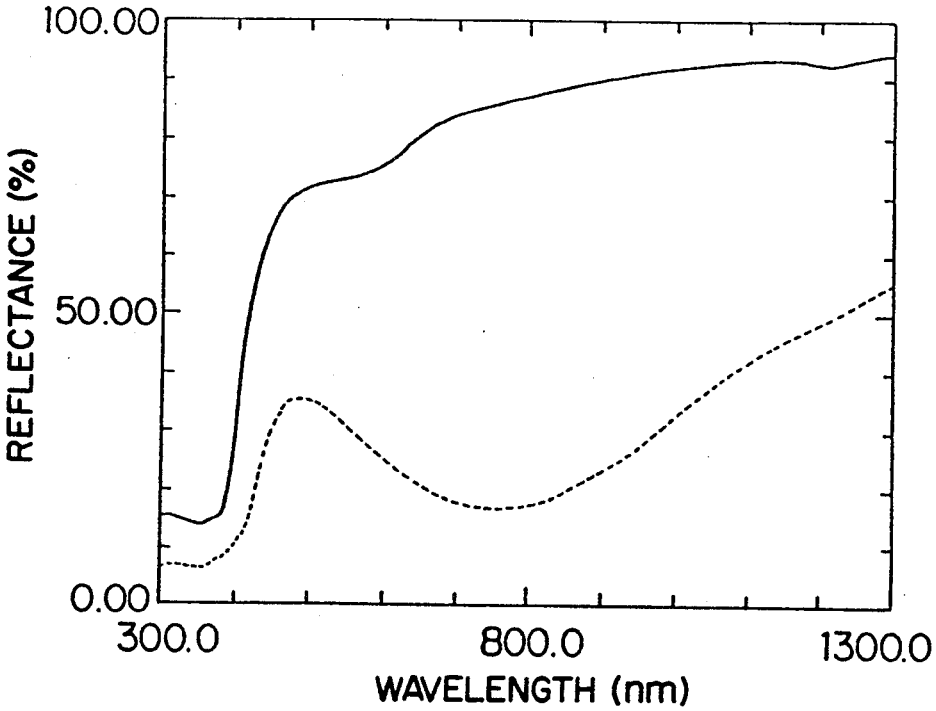
FIG. 35 is a reflection spectrum chart of a color-forming recording material obtained in Example 47 before and after color formation.

FIGS. 28 and 29 show the reflection spectra of the color-forming recording materials in Example 38 and Comparative Example 4 before and after the color formation.

EXAMPLE 42–47

0.05 Gram of the compound of formula (1)—0.0472 g of chloranil (−2.17 eV), 0.2178 g of 1-hydroxy-2-naphthoic acid, 0.20 g of stearic acid amide, 0.10 g of zinc stearate, 0.75 g of a 10% polyvinyl alcohol aqueous solution and 1.75 g of water were treated with a mill for 10 minutes to give a coating liquid.

The above-obtained coating liquid was coated on a fine paper with a bar coater (P11210, supplied by Tester Sangyo K. K.), and air-dried to give a color-forming recording material. The compounds of formula (1)-a used in each of Examples 42 to 47 were as follows:

Example 42: N-(4-acetylaminophenyl)-N'-phenyl-p-phenylenediamine,

Example 43: N-(4-t-butoxycarbonylaminophenyl)-N'-phenyl-p-phenylenediamine,

Example 44: N-(4-methoxycarbonyloxyphenyl)-N'-phenyl-p-phenylenediamine,

Example 45: N-(4-phenylaminocarbonyloxyphenyl)-N'-phenyl-p-phenylenediamine,

Example 46: N-(4-phenylaminocarbonylaminophenyl)-N'-phenyl-p-phenylenediamine,

Example 47: N-(3-acetylaminophenyl)-N'-phenyl-p-phenylenediamine,

The color formation was carried out under heat with a color-forming tester for thermo-sensitive paper (TH-PMD, supplied by Okura electric Co., Ltd), and the color-forming recording material coated on the sheet was measured for reflectance at 300 to 1,300 nm before and after color formation with a UV measuring apparatus (UV-3101, supplied by Shimadzu Corp.). FIGS. 30, 31, 32, 33, 34 and 35 show the reflection spectra before and after the color formation in Examples 42 to 47. The solid lines show the reflection spectra before the color formation, and the dotted lines show the reflection spectra after the color formation.

Bar code prints were formed on the thermo-sensitive paper sheet with the thermal head of an NEC printer (PC-PR102TL). The bar codes were readable with both a semiconductor laser (780 nm) bar code reader (LS8200, supplied by Symbol Technologies, Inc.) and an LED bar code reader (M10, supplied by Mechanosystems).

EXAMPLE 48

Example 42 was repeated except for the use of 2-naphthoic acid as an acidic substance to prepare a color-forming recording material, and a bar code print was formed in the same manner as in Example 42. The bar code was well-readable with both a semiconductor laser bar code reader and an LED bar code reader.

EXAMPLE 49

Example 43 was repeated except for the use of benzoic acid as an acidic substance and 2,5-dichlorobenzoquinone (LUMO −1.99 eV) as an oxidizing agent to prepare a color-forming recording material, and a bar code print was formed in the same manner as in Example 42. The bar code was well-readable with both a semiconductor laser bar code reader and an LED bar code reader.

EXAMPLE 50

Example 47 was repeated except for the use of benzoquinone (LUMO −1.71 eV) as an oxidizing agent to prepare a color-forming recording material, and a bar code print was formed in the same manner as in Example 42. The bar code was well-readable with both a semiconductor laser bar code reader and an LED bar code reader.

EXAMPLE 51

Example 44 was repeated except for the use of salicylic acid as an acidic substance and benzoquinone (LUMO −1.71 eV) as an oxidizing agent to prepare a color-forming recording material, and a bar code print was formed in the same manner as in Example 42. The bar code was well-readable with both a semiconductor laser bar code reader and an LED bar code reader.

EXAMPLE 52

0.05 Gram of N-phenyl-N'-(4-methoxyphenyl)-p-phenylenediamine, 0.0472 g of p-benzoquinone, 0.2178 g of 1-hydroxy-2-naphthoic acid, 0.20 g of stearic acid amide, 0.10 g of zinc stearate, 0.75 g of a 10% polyvinyl alcohol aqueous solution and 1.75 g of water were treated with a mill for 10 minutes to give a coating liquid.

Then, the above-obtained coating liquid was coated on a fine paper, and air-dried to give a color-forming recording material. The resultant color-forming recording material was color-formed under heat and measured for reflectance at 780 nm before and after the color formation.

Ground portion: 40%; Color formed portion: 10%

EXAMPLE 53

0.05 Gram of N,N'-diphenyl-p-phenylenediamine, 0.04 g of anthraquinone (LUMO −1.39 eV), 0.2178 g of 1-hydroxy-2-naphthoic acid, 0.20 g of stearic acid amide, 0.10 g of zinc stearate, 0.75 g of a 10% polyvinyl alcohol aqueous solution and 1.75 g of water were treated with a mill for 10 minutes to give a coating liquid.

Then, the above-obtained coating liquid was coated on a fine paper, and air-dried to give a color-forming recording material. The resultant color-forming recording material was color-formed under heat and measured for reflectance at 780 nm before and after the color formation.

Ground portion: 95%; Color formed portion: 70%

EXAMPLE 54

0.10 Gram of N,N'-diphenyl-p-phenylenediamine, 0.0275 g of silver chloride, 0.2178 g of 1-hydroxy-2-naphthoic acid, 0.20 g of stearic acid amide, 0.10 g of zinc stearate, 0.75 g of a 10% polyvinyl alcohol aqueous solution and 1.75 g of water were treated with a mill for 10 minutes to give a coating liquid.

Then, the above-obtained coating liquid was coated on a fine paper, and air-dried to give a color-forming recording material. The resultant color-forming recording material was color-formed under heat and measured for reflectance at 780 nm before and after the color formation.

Ground portion: 94%; Color formed portion: 72%

EXAMPLE 55

0.10 Gram of N,N'-diphenyl-p-phenylenediamine, 0.0258 g of cupric chloride, 0.2178 g of 1-hydroxy-2-naphthoic acid, 0.20 g of stearic acid amide, 0.10 g of zinc stearate, 0.75 g of a 10% polyvinyl alcohol aqueous solution and 1.75 g of water were treated with a mill for 10 minutes to give a coating liquid.

Then, the above-obtained coating liquid was coated on a fine paper, and air-dried to give a color-forming recording material. The resultant color-forming recording material was color-formed under heat and measured for reflectance at 780 nm before and after the color formation.

Ground portion: 85%; Color formed portion: 65%

Bar code prints were formed on the same thermo-sensitive paper sheets as those obtained in the above Example 52 to 55 with the thermal head of an NEC printer (PC-PR102TL). The bar codes were readable with both a semiconductor laser bar code reader and an LED bar code reader.

EXAMPLE 56

0.055 Gram of N-(3-aminophenyl)-N'-phenyl-p-phenylenediamine, 0.0246 g of chloranil, 0.1129 g of 1-hydroxy-2-naphthoic acid, 0.05 g of stearic acid amide, 0.05 g of zinc stearate, 0.40 g of a 10% polyvinyl alcohol aqueous solution and 0.90 g of water were treated with a mill for 10 minutes to give a coating liquid.

Then, the above-obtained coating liquid was coated on a fine paper, and air-dried to give a color-forming recording material. The resultant color-forming recording material was color-formed under heat with a color-forming tester for thermo-sensitive paper.

Figure 36:
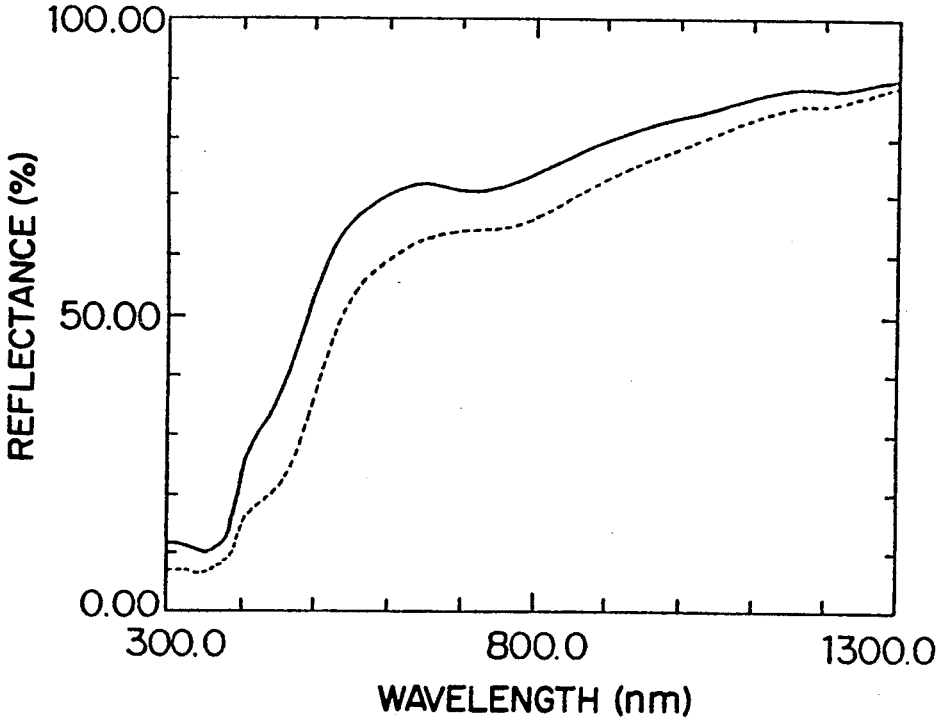
FIG. 36 is a reflection spectrum chart of a color-forming recording material obtained in Example 56 before and after color formation.

FIG. 36 shows a reflectance spectrum chart of the color-forming recording material before and after the color formation.

EXAMPLE 57

0.0634 Gram of N-(3-acetylaminophenyl)-N'-phenyl-p-phenylenediamine, 0.0246 g of chloranil, 0.1129 g of 1-hydroxy-2-naphthoic acid, 0.05 g of stearic acid amide, 0.05 g of zinc stearate, 0.40 g of a 10% polyvinyl alcohol aqueous solution and 0.90 g of water were treated with a mill for 10 minutes to give a coating liquid.

Then, the above-obtained coating liquid was coated on a fine paper, and air-dried to give a color-forming recording material. The resultant color-forming recording material was color-formed under heat with a color-forming tester for thermo-sensitive paper.

Figure 37:
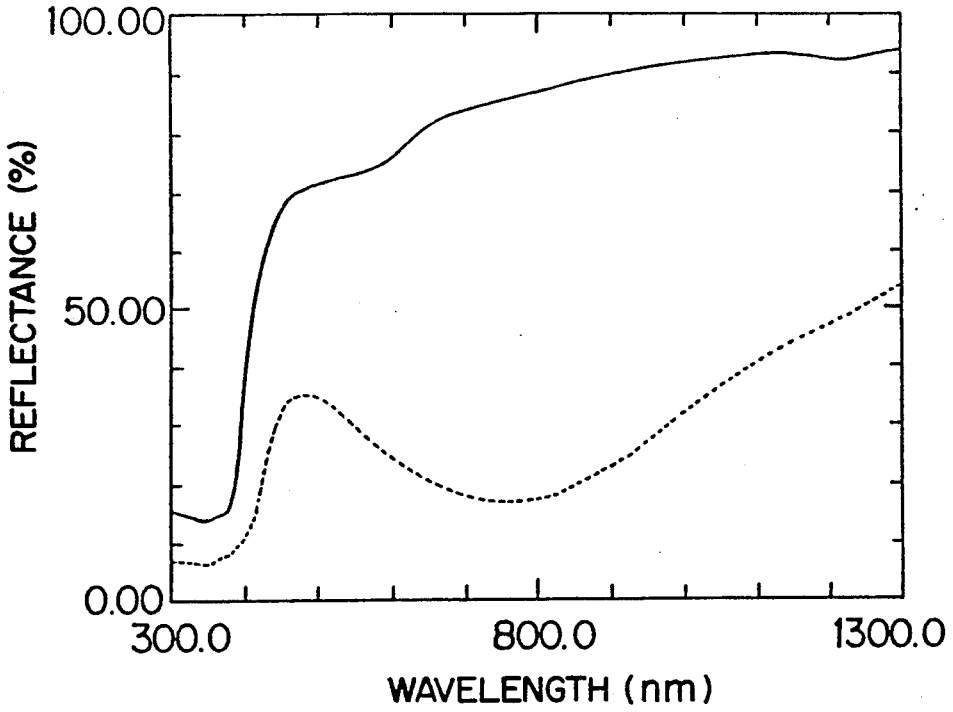
FIG. 37 is a reflection spectrum chart of a color-forming recording material obtained in Example 57 before and after color formation.

FIG. 37 shows a reflectance spectrum chart of the color-forming recording material before and after the color formation.

EXAMPLE 58

0.0860 Gram of N-[4-(toluenesulfonyloxy)phenyl]-N'-phenyl-p-phenylenediamine, 0.0246 g of chloranil, 0.2730 g of bisphenol A, 0.05 g of stearic acid amide, 0.05 g of zinc stearate, 0.40 g of a 10% polyvinyl alcohol aqueous solution and 0.90 g of water were treated with a mill for 10 minutes to give a coating liquid.

Then, the above-obtained coating liquid was coated on a fine paper, and air-dried to give a color-forming recording material. The resultant color-forming recording material was color-formed under heat with a color-forming tester for thermo-sensitive paper.

Figure 38:
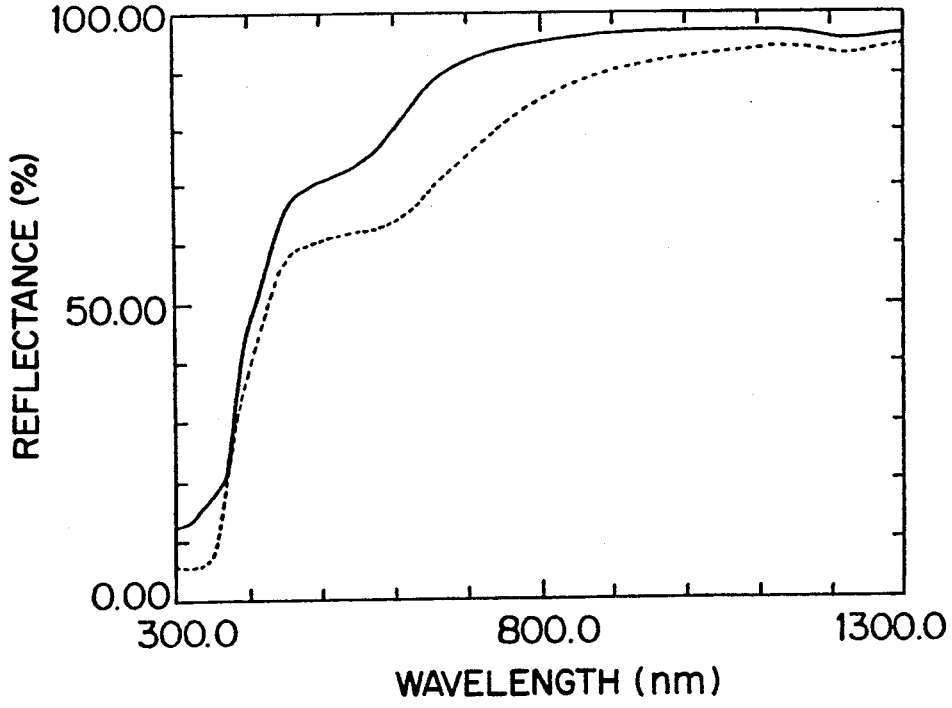
FIG. 38 is a reflection spectrum chart of a color-forming recording material obtained in Example 58 before and after color formation.

FIG. 38 shows a reflectance spectrum chart of the color-forming recording material before and after the color formation.

EXAMPLE 59

0.0858 Gram of N-[4-(toluenesulfonylamino)phenyl]-N'-phenyl-p-phenylenediamine, 0.0042 g of R-DCF (supplied by Yamada Chemical Co. Ltd), 0.0246 g of chloranil, 0.1129 g of 1-hydroxy-2-naphthoic acid, 0.05 g of stearic acid amide, 0.05 g of zinc stearate, 0.40 g of a 10% polyvinyl alcohol aqueous solution and 0.90 g of water were treated with a mill for 10 minutes to give a coating liquid.

Then, the above-obtained coating liquid was coated on a fine paper, and air-dried to give a color-forming recording material. The resultant color-forming recording material was color-formed under heat with a color-forming tester for thermo-sensitive paper.

Figure 39:
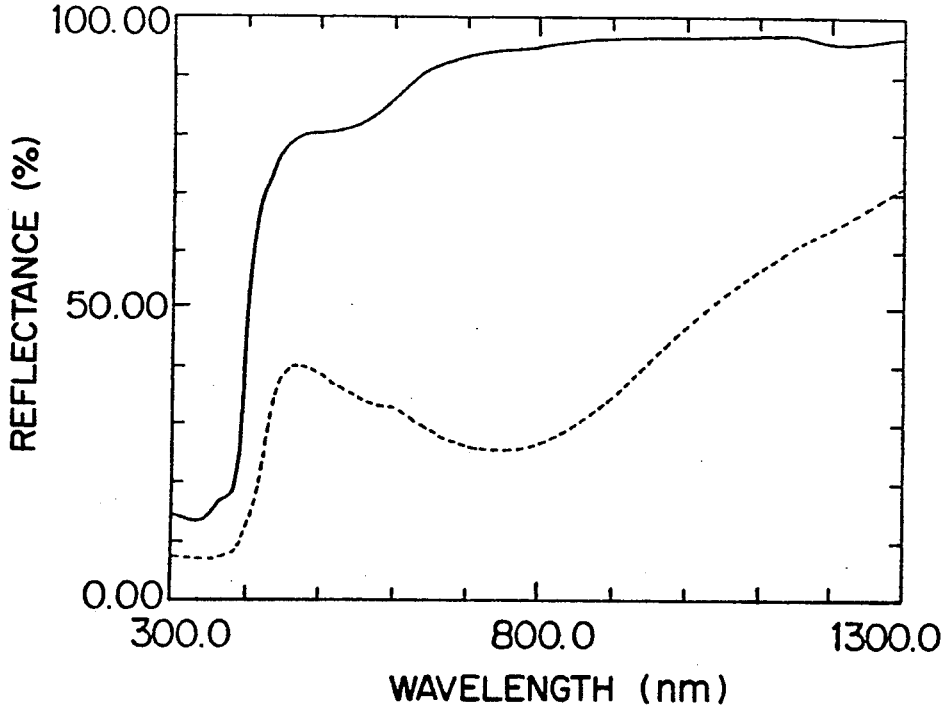
FIG. 39 is a reflection spectrum chart of a color-forming recording material obtained in Example 59 before and after color formation.

FIG. 39 shows a reflectance spectrum chart of the color-forming recording material before and after the color formation.

EXAMPLE 60

0.0512 Gram of N-(4-methoxyphenyl]-N,N',N'-trimethyl-p-phenylenediamine, 0.0246 g of chloranil, 0.1129 g of 1-hydroxy-2-naphthoic acid, 0.05 g of stearic acid amide, 0.05 g of zinc stearate, 0.40 g of a 10% polyvinyl alcohol aqueous solution and 0.90 g of water were treated with a mill for 10 minutes to give a coating liquid.

Then, the above-obtained coating liquid was coated on a fine paper, and air-dried to give a color-forming recording material. The resultant color-forming recording material was color-formed under heat with a color-forming tester for thermo-sensitive paper.

Figure 40:
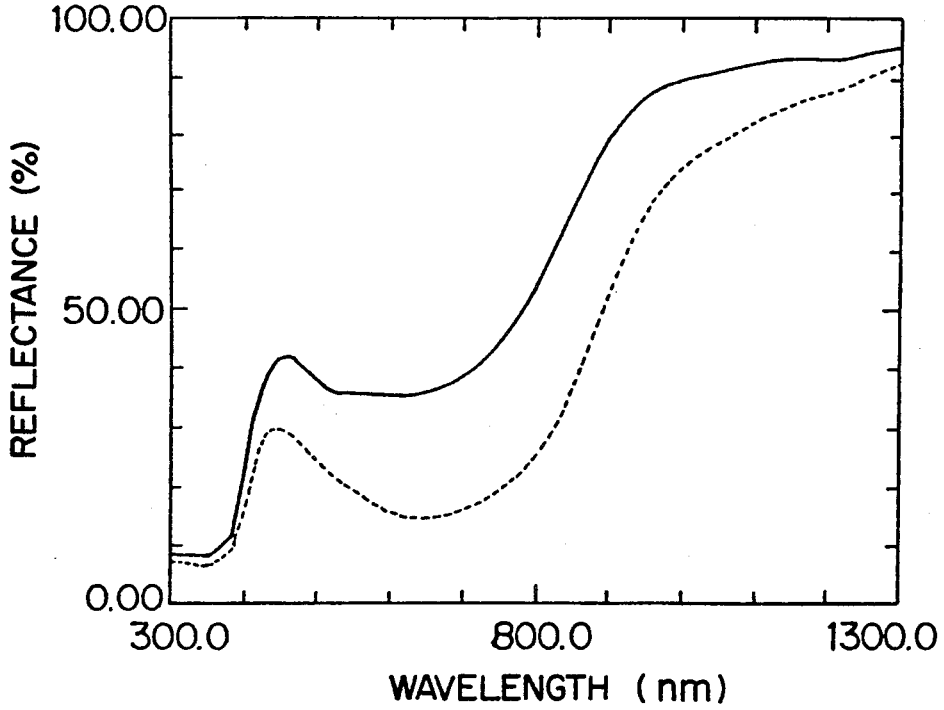
FIG. 40 is a reflection spectrum chart of a color-forming recording material obtained in Example 60 before and after color formation.

FIG. 40 shows a reflectance spectrum chart of the color-forming recording material before and after the color formation.

EXAMPLE 61

0.0636 Gram of N,N'-dimethyl-N-(4-methoxyphenyl)-N'-phenyl-p-phenylenediamine, 0.0246 g of chloranil, 0.2730 g of bisphenol A, 0.05 g of stearic acid amide, 0.05 g of zinc stearate, 0.40 g of a 10% polyvinyl alcohol aqueous solution and 0.90 g of water were treated with a mill for 10 minutes to give a coating liquid.

Then, the above-obtained coating liquid was coated on a fine paper, and air-dried to give a color-forming recording material. The resultant color-forming recording material was color-formed under heat with a color-forming tester for thermo-sensitive paper.

Figure 41:
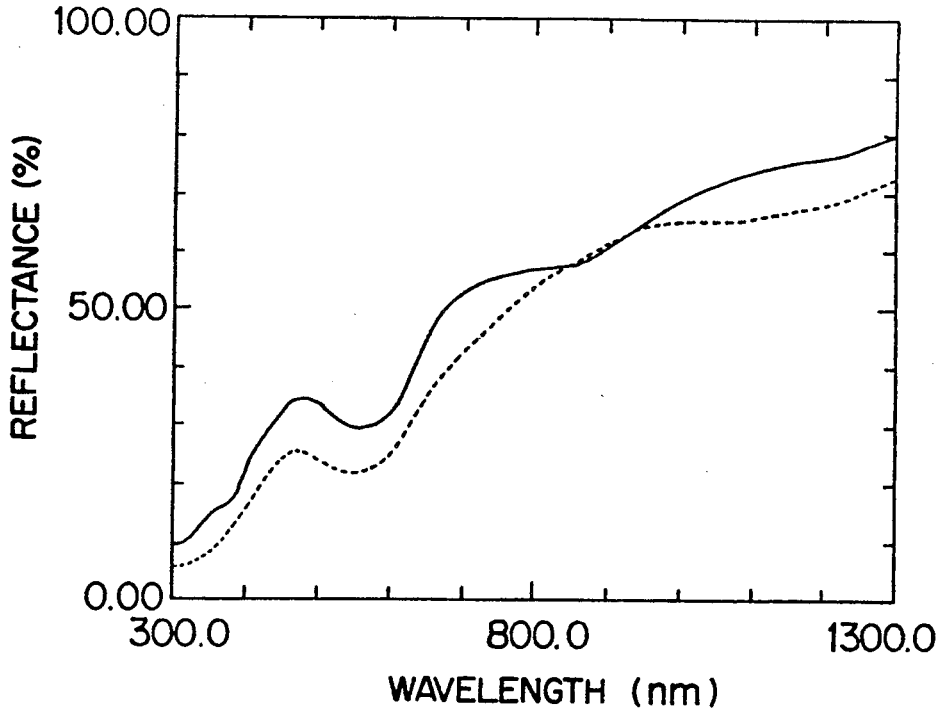
FIG. 41 is a reflection spectrum chart of a color-forming recording material obtained in Example 61 before and after color formation.

FIG. 41 shows a reflectance spectrum chart of the color-forming recording material before and after the color formation.

EXAMPLE 62

0.0576 Gram of N,N'-diphenyl-N,N'-diphenyl-p-phenylenediamine, 0.0246 g of chloranil, 0.1129 g of 1-hydroxy-2-naphthoic acid, 0.05 g of stearic acid amide, 0.05 g of zinc stearate, 0.40 g of a 10% polyvinyl alcohol aqueous solution and 0.90 g of water were treated with a mill for 10 minutes to give a coating liquid.

Then, the above-obtained coating liquid was coated on a fine paper, and air-dried to give a color-forming recording material. The resultant color-forming recording material was color-formed under heat with a color-forming tester for thermo-sensitive paper.

Figure 42:
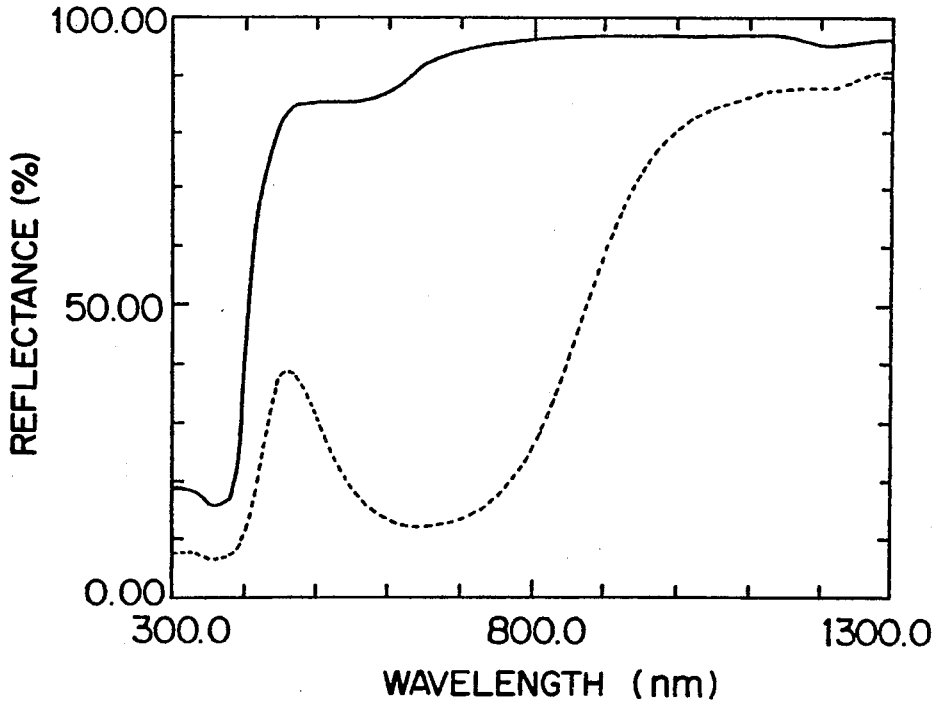
FIG. 42 is a reflection spectrum chart of a color-forming recording material obtained in Example 62 before and after color formation.

FIG. 42 shows a reflectance spectrum chart of the color-forming recording material before and after the color formation.

EXAMPLE 63

0.0576 Gram of N,N'-diphenyl-N,N'-diphenyl-p-phenylenediamine, 0.0246 g of chloranil, 0.2730 g of bisphenol A, 0.05 g of stearic acid amide, 0.05 g of zinc stearate, 0.40 g of a 10% polyvinyl alcohol aqueous solution and 0.90 g of water were treated with a mill for 10 minutes to give a coating liquid.

Then, the above-obtained coating liquid was coated on a fine paper, and air-dried to give a color-forming recording material. The resultant color-forming recording material was color-formed under heat with a color-forming tester for thermo-sensitive paper.

Figure 43:
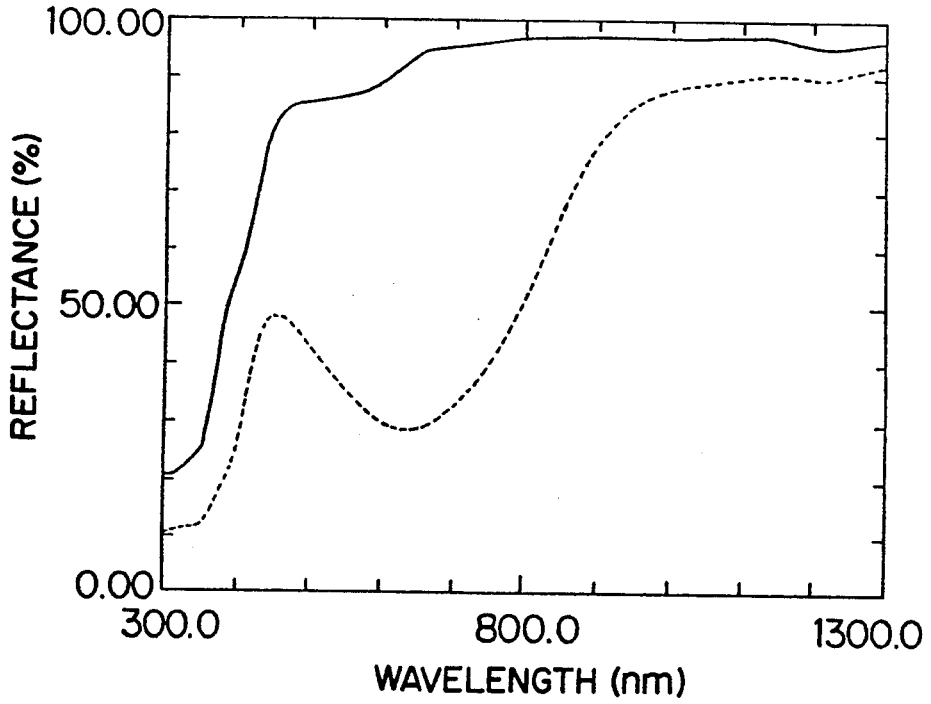
FIG. 43 is a reflection spectrum chart of a color-forming recording material obtained in Example 63 before and after color formation.

FIG. 43 shows a reflectance spectrum chart of the color-forming recording material before and after the color formation.

EXAMPLE 64

0.0636 Gram of N,N'-dimethyl-N-(4-methoxyphenyl)-N'-phenyl-p-phenylenediamine, 0.0246 g of chloranil, 0.1129 g of 1-hydroxy-2-naphthoic acid, 0.05 g of stearic acid amide, 0.05 g of zinc stearate, 0.40 g of a 10% polyvinyl alcohol aqueous solution and 0.90 g of water were treated with a mill for 10 minutes to give a coating liquid.

Then, the above-obtained coating liquid was coated on a fine paper, and air-dried to give a color-forming recording material. The resultant color-forming recording material was color-formed under heat with a color-forming tester for thermo-sensitive paper.

Figure 44:
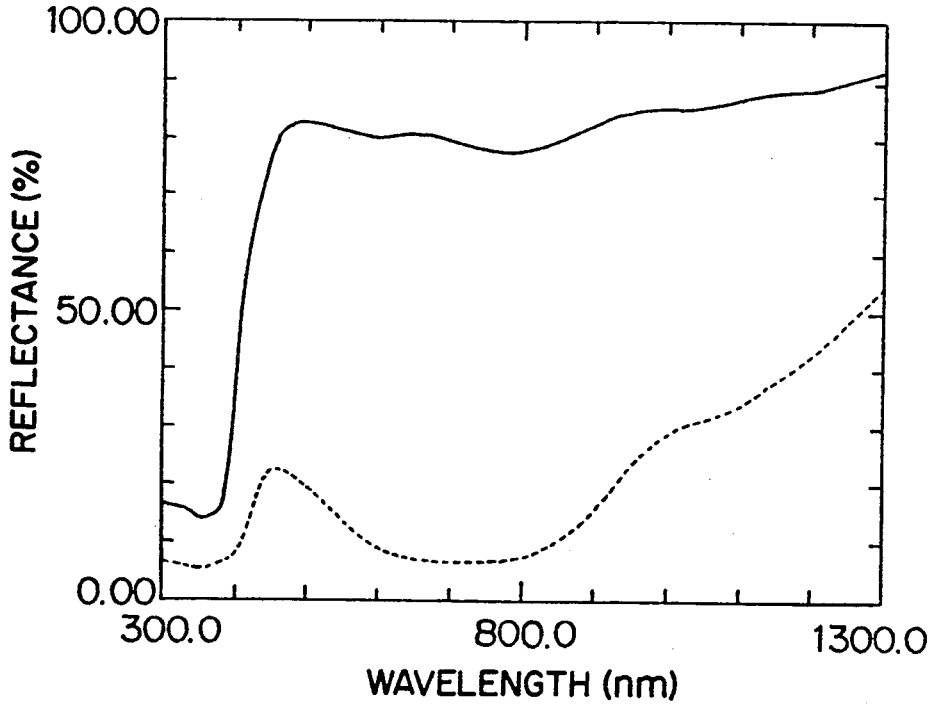
FIG. 44 is a reflection spectrum chart of a color-forming recording material obtained in Example 64 before and after color formation.

FIG. 44 shows a reflectance spectrum chart of the color-forming recording material before and after the color formation.

EXAMPLE 65

0.0608 Gram of N,N'-dimethyl-N-(4-hydroxyphenyl)-N'-phenyl-p-phenylenediamine, 0.0246 g of chloranil, 0.1129 g of 1-hydroxy-2-naphthoic acid, 0.05 g of stearic acid amide, 0.05 g of zinc stearate, 0.40 g of a 10% polyvinyl alcohol aqueous solution and 0.90 g of water were treated with a mill for 10 minutes to give a coating liquid.

Then, the above-obtained coating liquid was coated on a fine paper, and air-dried to give a color-forming recording material. The resultant color-forming recording material was color-formed under heat with a color-forming tester for thermo-sensitive paper.

Figure 45:
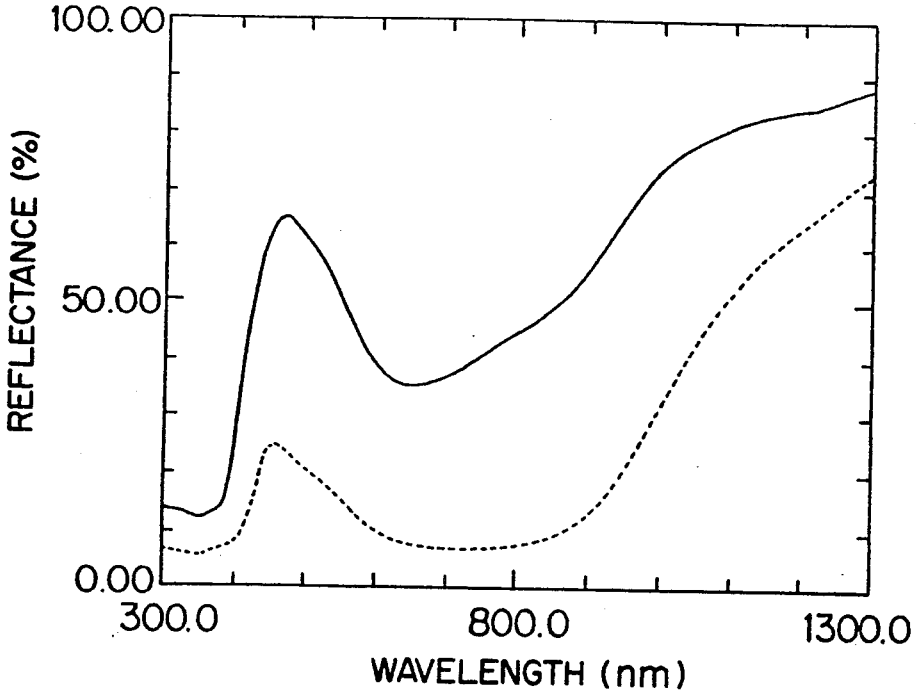
FIG. 45 is a reflection spectrum chart of a color-forming recording material obtained in Example 65 before and after color formation.

FIG. 45 shows a reflectance spectrum chart of the color-forming recording material before and after the color formation.

EXAMPLE 66

0.0914 Gram of N,N'-dimethyl-N-[3-N-toluenesulfonyl-N-methylamino)phenyl]-N'-phenyl-p-phenylenediamine, 0.0246 g of chloranil, 0.1129 g of 1-hydroxy-2-naphthoic acid, 0.05 g of stearic acid amide, 0.05 g of zinc stearate, 0.40 g of a 10% polyvinyl alcohol aqueous solution and 0.90 g of water were treated with a mill for 10 minutes to give a coating liquid.

Then, the above-obtained coating liquid was coated on a fine paper, and air-dried to give a color-forming recording material. The resultant color-forming recording material was color-formed under heat with a color-forming tester for thermo-sensitive paper.

Figure 46:
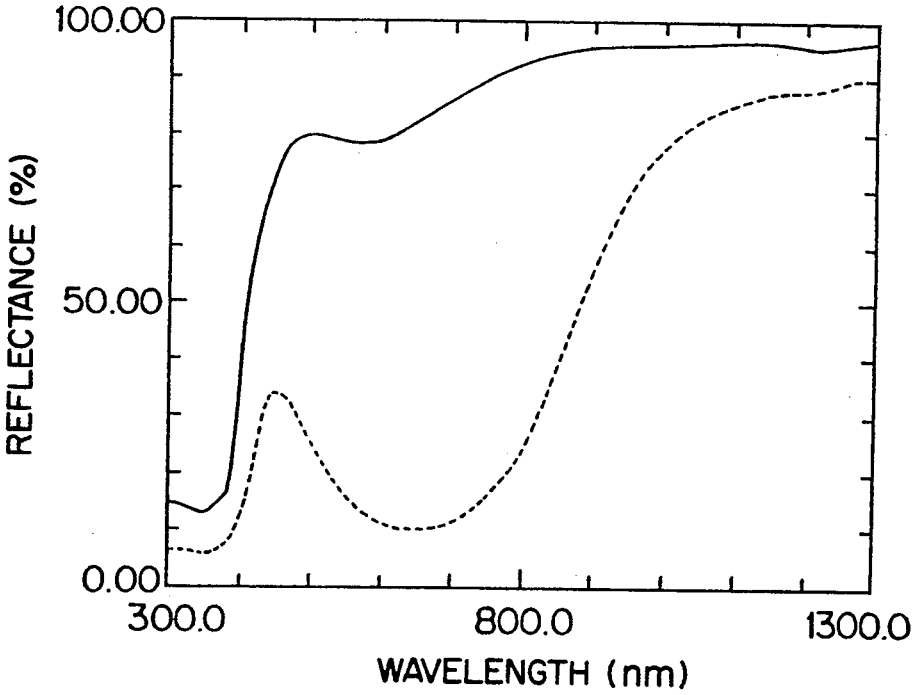
FIG. 46 is a reflection spectrum chart of a color-forming recording material obtained in Example 66 before and after color formation.

FIG. 46 shows a reflectance spectrum chart of the color-forming recording material before and after the color formation.

What is claimed is:

1. A color-forming recording material having a substrate and containing:

(a) an aromatic diamine, (b) an oxidizing agent, and (c) an acidic substance.

2. The color-forming recording material of claim 1, wherein the aromatic diamine (a) has the formula (1),

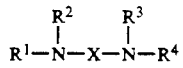

(1)

wherein each of $R^1$ and $R^4$ is, independently of the other, a substituted or unsubstituted aryl group, each of $R^2$ and $R^3$ is, independently of the other, a hydrogen atom, a lower alkyl group, a substituted or unsubstituted aryl group or a substituted or unsubstituted aralkyl group, and X is a substituted or unsubstituted arylene group.

3. The color-forming recording material of claim 2, wherein the substituted aryl groups as $R^1$ or $R^4$, the substituted aryl groups and substituted aralkyl groups as $R^2$ or $R^3$, and the arylene group as X in the definition of the formula (1) each independently has a substituent selected from the group consisting of a halogen atom, a cyano group, a nitro group, an alkyl group, an aryl group, an aralkyl group, a hydroxyl group, an alkoxy group, an aryloxy group, an aralkyloxy group, an acyl group, a carboxyl group, an alkoxycarbonyl group, an aryloxycarbonyl group, an alkyl-substituted carbamoyl group, an aryl-substituted carbamoyl group, a sulfonic acid group, an alkylsulfonyl group, an arylsulfonyl group, an amino group, an alkyl-substituted amino group, an aryl-substituted amino group, pyrrolidino group, and a piperidino group.

4. The color-forming recording material of claim 2, wherein the substituted aryl group as $R^4$ in the definition of the formula (1) has a substituent of the formula (1)-a,

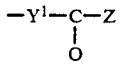

(1)-a wherein $Y^1$ is —O—, —NH—, —N(lower alkyl)—, —N(aryl)— or —N(aralkyl)—, and Z is a hydrogen atom, an alkyl group, an aryl group, an aralkyl group, an alkoxy group, an aryloxy group, an aralkyloxy group, an alkyl-substituted amino group or an aryl-substituted amino group.

5. The color-forming recording material of claim 2, wherein the substituted aryl group as $R^4$ in the definition of the formula (1) has a substituent of the formula (1)-b,

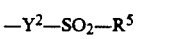

(1)-b wherein $Y^2$ is —O—, —NH—, —N(lower alkyl)—, —N(aryl)— or —N(aralkyl)— and $R^5$ is an alkyl group, an aryl group or an aralkyl group.

6. The color-forming recording material of claim 2, wherein the substituted aryl group as $R^4$ in the definition of the formula (1) has a substituent of the formula the formula (1)-c,

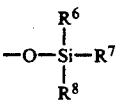

(1)-c wherein $R^6$, $R^7$ and $R^8$ are each independently an alkyl group, an aryl group or an aralkyl group.

7. The color-forming recording material of claim 1, wherein the aromatic diamine has the formula (2),

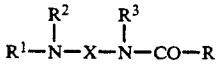

(2)

wherein $R^1$ is a substituted or unsubstituted aryl group, each of $R^2$ and $R^3$ is, independently of the other, a hydrogen atom, a lower alkyl group, a substituted or unsubstituted aryl group or a substituted or unsubstituted aralkyl group, X is a substituted or unsubstituted arylene group, and R is an alkyl group, an aryl group or an aralkyl group.

8. The color-forming recording material of claim 1, wherein the oxidizing agent (b) is a quinoid electron-accepting compound.

9. The color-forming recording material of claim 1, wherein the oxidizing agent (b) is a quinoid electron-accepting compound having an LUMO energy level of −2.80 to −1.30 eV, calculated according to an MNDO-PM3 molecular orbital method.

10. The color-forming recording material of claim 1, wherein the acidic substance (c) is a solid organic acid at a normal temperature.

11. The color-forming recording material of claim 1, wherein the acidic substance (c) is an aromatic carboxylic acid.

12. The color-forming recording material of claim 1, wherein a color-forming dye is further contained in the recording material.

13. The color-forming recording material of claim 1, wherein the substrate is paper.

* * * * *